US011510003B1

(12) United States Patent
Saplakoglu et al.

(10) Patent No.: US 11,510,003 B1
(45) Date of Patent: Nov. 22, 2022

(54) DISTRIBUTED FEEDBACK ECHO CANCELLATION

(71) Applicant: Amazon Technologies, Inc., Seattle, WA (US)

(72) Inventors: Gurhan Saplakoglu, Acton, MA (US); Alexander Kanaris, San Jose, CA (US); Berkant Tacer, Bellevue, WA (US)

(73) Assignee: Amazon Technologies, Inc., Seattle, WA (US)

( * ) Notice: Subject to any disclaimer, the term of this patent is extended or adjusted under 35 U.S.C. 154(b) by 19 days.

(21) Appl. No.: 17/116,509

(22) Filed: Dec. 9, 2020

(51) Int. Cl.
*H04R 3/00* (2006.01)
*H04R 3/02* (2006.01)

(52) U.S. Cl.
CPC ..... *H04R 3/02* (2013.01)

(58) Field of Classification Search
CPC . H04R 3/00; H04R 3/005; H04R 3/02; H04R 2430/23; G10K 11/16; G10K 11/17881; G10K 11/17885; G10L 21/02; G10L 21/0208; G10L 21/02082; G10L 21/0356; H04M 9/08; H04M 9/082
See application file for complete search history.

(56) References Cited

U.S. PATENT DOCUMENTS 5,033,082 A * 7/1991 Eriksson ..... G10K 11/17885 381/71.11
6,895,093 B1 * 5/2005 Ali ..... H04B 3/23 379/406.01
9,412,354 B1 * 8/2016 Ramprashad ..... H04R 3/005
9,916,840 B1 * 3/2018 Do ..... H04M 9/082
2002/0071573 A1 * 6/2002 Finn ..... H04M 9/08 381/95
2002/0159603 A1 * 10/2002 Hirai ..... H04S 1/002 381/63
2011/0311064 A1 * 12/2011 Teutsch ..... H04M 9/082 381/26
2014/0003611 A1 * 1/2014 Mohammad ..... H04B 3/20 381/66
2014/0003635 A1 * 1/2014 Mohammad ..... G10K 11/16 381/306
2017/0084286 A1 * 3/2017 Kim ..... G10L 21/0216

* cited by examiner

*Primary Examiner* — Thang V Tran
(74) *Attorney, Agent, or Firm* — Pierce Atwood LLP

(57) ABSTRACT

A system configured to perform distributed echo cancellation processing to attenuate feedback echo from occurring when two devices are acoustically coupled during a communication session. To reduce the feedback echo, one of the devices is configured as a hub device and receives microphone signals, synchronizes the microphone signals, and generates a mixed microphone signal. To enable distributed echo cancellation, the system includes bidirectional feedback link(s) between the hub device and each device synchronized with the hub device. For example, a first bidirectional feedback link sends a microphone signal from a second device to the hub device and sends the mixed microphone signal from the hub device to the second device, which the second device uses to perform echo cancellation. In addition, a second bidirectional feedback link sends a playback signal from the hub device to the second device and sends the output of echo cancellation back to the hub device.

20 Claims, 17 Drawing Sheets

DISTRIBUTED FEEDBACK ECHO CANCELLATION

BACKGROUND

With the advancement of technology, the use and popularity of electronic devices has increased considerably. Electronic devices are commonly used to capture and process audio data.

BRIEF DESCRIPTION OF DRAWINGS

For a more complete understanding of the present disclosure, reference is now made to the following description taken in conjunction with the accompanying drawings.

DETAILED DESCRIPTION

Electronic devices may be used to capture and/or process audio data as well as output audio represented in the audio data. During a communication session between a first device and a second device, such as a Voice over Internet Protocol (VoIP) communication session, the first device may capture first audio data and send the first audio data to the second device for playback, and the second device may use the first audio data to generate first audio. If the first device and the second device are located in proximity to each other, they may be acoustically coupled. This acoustic coupling may cause feedback echo or other artifacts/distortions that decrease an audio quality of the communication session and/or negatively affect a user experience.

To improve the audio quality and/or the user experience during a communication session, devices, systems and methods are disclosed that perform distributed echo cancellation processing to attenuate the echo signals (e.g., feedback echo). For example, the system may synchronize multiple microphone audio signals and generate a mixed microphone audio signal using the synchronized microphone audio signals. To enable distributed echo cancellation processing, the system may include bidirectional feedback link(s) between a first device and a second device. For example, a first feedback link may send a microphone signal from the second device to the first device, and the system may make the first feedback link bidirectional by sending the mixed microphone audio signal from the first device to the second device. Thus, instead of performing echo cancellation using the microphone audio signal generated by the second device, the second device performs echo cancellation using the mixed microphone audio signal to generate a second modified audio signal. Additionally or alternatively, a second feedback link may send a playback signal from the first device to the second device, and the system may make the second feedback link bidirectional by sending the second modified audio signal from the second device back to the first device.

Figure 1:
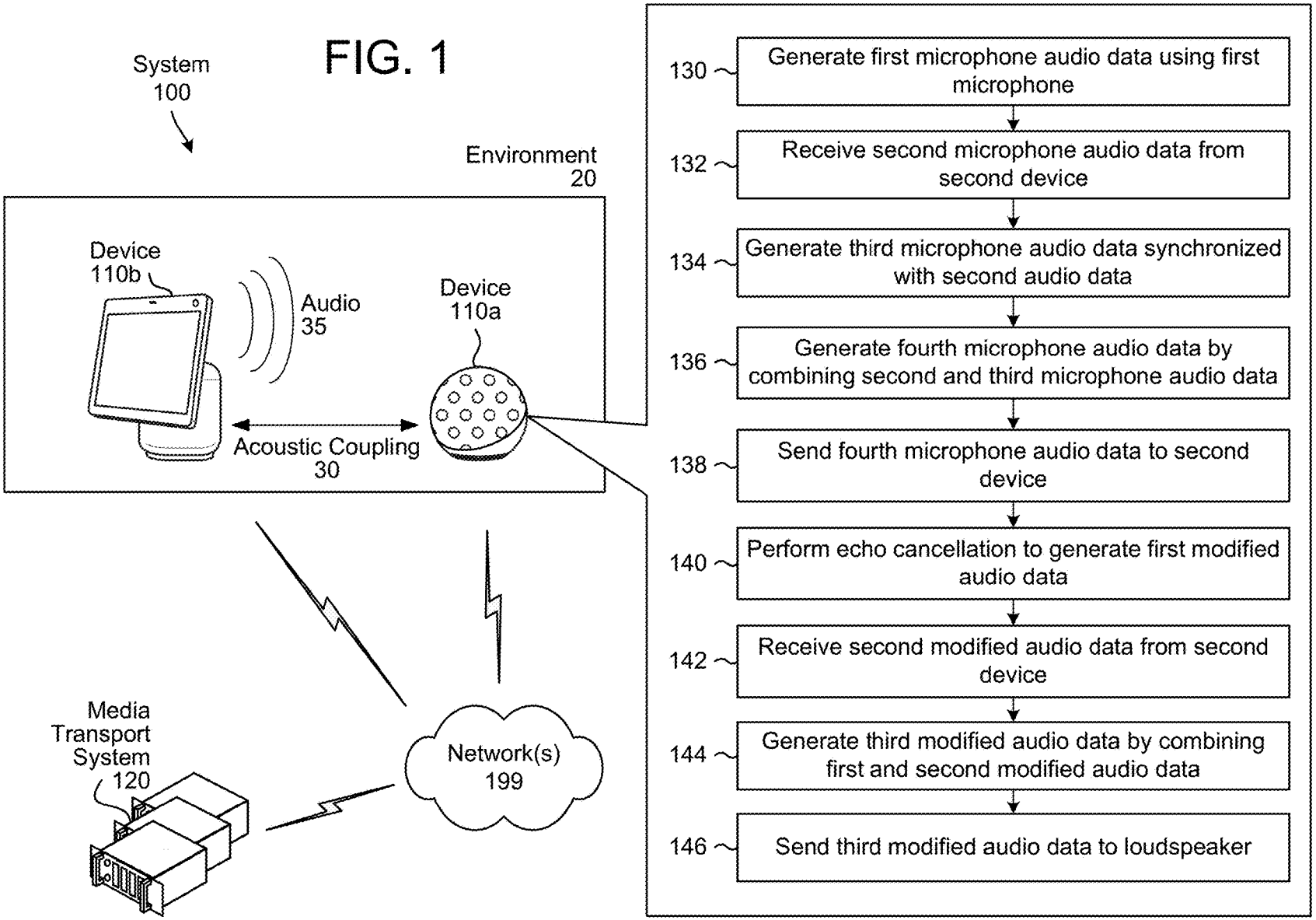
FIG. 1 illustrates a system for performing distributed feedback echo cancellation according to embodiments of the present disclosure.

FIG. 1 illustrates a high-level conceptual block diagram of a system 100 configured to perform distributed feedback echo cancellation according to embodiments of the disclosure. Although FIG. 1 and other figures/discussion illustrate the operation of the system in a particular order, the steps described may be performed in a different order (as well as certain steps removed or added) without departing from the intent of the disclosure. As illustrated in FIG. 1, the system 100 may include a first device 110*a*, a second device 110*b*, and/or a media transport system 120 that may be communicatively coupled to network(s) 199. For example, the media transport system 120 may be configured to enable a communication session between the first device 110*a* and the second device 110*b*, although the disclosure is not limited thereto.

As used herein, the communication session may correspond to a Voice over Internet Protocol (VoIP) communication session, although the disclosure is not limited thereto. If the first device 110*a* is in physical proximity to the second device 110*b*, the first device 110*a* may become acoustically coupled to the second device 110*b* during the communication session. For example, FIG. 1 illustrates an example in which the first device 110*a* and the second device 110*b* are located in proximity to one another within an environment 20. Due to this proximity, the first device 110*a* may recapture a portion of audio 35 output by the second device 110*b*, which results in acoustic coupling 30. This acoustic coupling may cause feedback echo or other artifacts/distortions that decrease an audio quality of the communication session and/or negatively affect a user experience.

To improve the audio quality and/or the user experience, the system 100 may be configured to perform distributed echo cancellation processing to attenuate the echo signals (e.g., feedback echo). As described in greater detail below with regard to FIG. 7, the first device 110*a* may synchronize microphone audio signals generated by multiple devices 110. For example, the second device 110*b* may send second microphone audio data to the first device 110*a* and the first device 110*a* may synchronize the second microphone audio data with first microphone audio data generated by the first device 110*a*. After synchronizing the microphone audio signals, the first device 110*a* may generate mixed microphone audio data by combining the synchronized microphone audio signals.

To enable the second device 110*b* to perform echo cancellation as part of distributed echo cancellation processing, the system 100 may include bidirectional feedback link(s) between the first device 110*a* and the second device 110*b*. For example, a first feedback link may send a microphone signal from the second device 110*b* to the first device 110*a*, and the system 100 may make the first feedback link bidirectional by sending the mixed microphone audio data from the first device 110*a* back to the second device 110*b*. Thus, instead of performing echo cancellation using the second microphone audio data, the second device 110*b* may perform echo cancellation using the mixed microphone audio data. For example, the second device 110*b* may perform echo cancellation by subtracting second playback audio data from the mixed microphone audio data to generate second modified audio data. Additionally or alternatively, a second feedback link may send the second playback audio data from the first device 110*a* to the second device 110*b* and the system 100 may make the second feedback link bidirectional by sending the second modified audio data from the second device 110*b* back to the first device 110*a*.

As illustrated in FIG. 1, the first device 110*a* may generate (130) first microphone audio data using a first microphone 112*a* associated with the first device 110*a*, may receive (132) second microphone audio data from the second device 110*b* (e.g., generated by a second microphone 112*b* associated with the second device 110*b*), and may use the first microphone audio data to generate (134) third microphone audio data synchronized with the second microphone audio data. For example, the first device 110*a* may generate the third microphone audio data by adding a first delay to the first microphone audio data, thereby synchronizing (e.g., aligning) the third microphone audio data and the second microphone audio data. The first delay may correspond to a network delay between the second device 110*b* and the first device 110*a*, which the first device 110*a* may determine using any techniques without departing from the disclosure.

The first device 110*a* may generate (136) fourth microphone audio data by combining the second microphone audio data and the third microphone audio data and may send (138) the fourth microphone audio data to the second device 110*b*. For example, the first device 110*a* may send the fourth microphone audio data to the second device 110*b* and the second device 110*b* may perform echo cancellation using the fourth microphone audio data (e.g., mixed microphone audio data) and a second playback signal associated with the second device 110*b* to generate second modified audio data.

The first device 110*a* may perform (140) echo cancellation using the fourth microphone audio data to generate first modified audio data. For example, the first device 110*a* may perform echo cancellation using the fourth microphone audio data (e.g., mixed microphone audio data) and a first playback signal associated with the first device 110*a*.

The first device 110*a* may receive (142) the second modified audio data from the second device 110*b* and may generate (144) third modified audio data by combining the first modified audio data and the second modified audio data. The first device 110*a* may then send (146) the third modified audio data to a loudspeaker associated with the first device 110*a*. While not illustrated in FIG. 1, the first device 110*a* may also send the third modified audio data to the second device 110*b* for playback.

An audio signal is a representation of sound and an electronic representation of an audio signal may be referred to as audio data, which may be analog and/or digital without departing from the disclosure. For ease of illustration, the disclosure may refer to either audio data (e.g., microphone audio data, input audio data, etc.) or audio signals (e.g., microphone signal, input audio signal, etc.) without departing from the disclosure. Additionally or alternatively, portions of a signal may be referenced as a portion of the signal or as a separate signal and/or portions of audio data may be referenced as a portion of the audio data or as separate audio data. For example, a first audio signal may correspond to a first period of time (e.g., 30 seconds) and a portion of the first audio signal corresponding to a second period of time (e.g., 1 second) may be referred to as a first portion of the first audio signal or as a second audio signal without departing from the disclosure. Similarly, first audio data may correspond to the first period of time (e.g., 30 seconds) and a portion of the first audio data corresponding to the second period of time (e.g., 1 second) may be referred to as a first portion of the first audio data or second audio data without departing from the disclosure. Audio signals and audio data may be used interchangeably, as well; a first audio signal may correspond to the first period of time (e.g., 30 seconds) and a portion of the first audio signal corresponding to a second period of time (e.g., 1 second) may be referred to as first audio data without departing from the disclosure.

In some examples, the audio data may correspond to audio signals in a time-domain. However, the disclosure is not limited thereto and the device 110 may convert these signals to a subband-domain or a frequency-domain prior to performing additional processing, such as adaptive feedback reduction (AFR) processing, acoustic echo cancellation (AEC), noise reduction (NR) processing, and/or the like. For example, the device 110 may convert the time-domain signal to the subband-domain by applying a bandpass filter or other filtering to select a portion of the time-domain signal within a desired frequency range. Additionally or alternatively, the device 110 may convert the time-domain signal to the frequency-domain using a Fast Fourier Transform (FFT) and/or the like.

As used herein, audio signals or audio data (e.g., microphone audio data, or the like) may correspond to a specific range of frequency bands. For example, the audio data may correspond to a human hearing range (e.g., 20 Hz-20 kHz), although the disclosure is not limited thereto.

As used herein, a frequency band (e.g., frequency bin) corresponds to a frequency range having a starting frequency and an ending frequency. Thus, the total frequency range may be divided into a fixed number (e.g., 256, 512, etc.) of frequency ranges, with each frequency range referred to as a frequency band and corresponding to a uniform size. However, the disclosure is not limited thereto and the size of the frequency band may vary without departing from the disclosure.

Figure 2A:
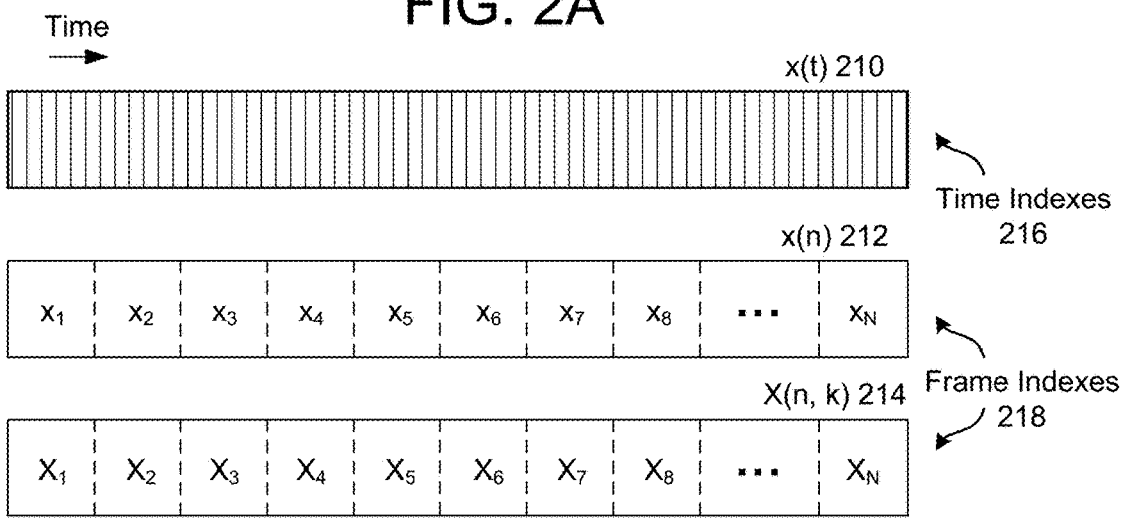
FIGS. 2A-2D illustrate examples of frame indexes, tone indexes, and channel indexes.

FIGS. 2A-2D illustrate examples of frame indexes, tone indexes, and channel indexes. As described above, the device 110 may generate microphone audio data $x_m(t)$ using microphone(s). For example, a first microphone may generate first microphone audio data $x_{m1}(t)$ in the time-domain, a second microphone may generate second microphone audio data $x_{m2}(t)$ in the time-domain, and so on. As illustrated in FIG. 2A, a time-domain signal may be represented as microphone audio data x(t) 210, which is comprised of a sequence of individual samples of audio data. Thus, x(t) denotes an individual sample that is associated with a time t.

While the microphone audio data x(t) 210 is comprised of a plurality of samples, in some examples the device 110 may group a plurality of samples and process them together. As illustrated in FIG. 2A, the device 110 may group a number of samples together in a frame to generate microphone audio data x(n) 212. As used herein, a variable x(n) corresponds to the time-domain signal and identifies an individual frame (e.g., fixed number of samples s) associated with a frame index n.

In some examples, the device 110 may convert microphone audio data x(t) 210 from the time-domain to the subband-domain. For example, the device 110 may use a plurality of bandpass filters to generate microphone audio data x(t, k) in the subband-domain, with an individual bandpass filter centered on a narrow frequency range. Thus, a first bandpass filter may output a first portion of the microphone audio data x(t) 210 as a first time-domain signal associated with a first subband (e.g., first frequency range), a second bandpass filter may output a second portion of the microphone audio data x(t) 210 as a time-domain signal associated with a second subband (e.g., second frequency range), and so on, such that the microphone audio data x(t, k) comprises a plurality of individual subband signals (e.g., subbands). As used herein, a variable x(t, k) corresponds to the subband-domain signal and identifies an individual sample associated with a particular time t and tone index k.

For ease of illustration, the previous description illustrates an example of converting microphone audio data x(t) 210 in the time-domain to microphone audio data x(t, k) in the subband-domain. However, the disclosure is not limited thereto, and the device 110 may convert microphone audio data x(n) 212 in the time-domain to microphone audio data x(n, k) the subband-domain without departing from the disclosure.

Additionally or alternatively, the device 110 may convert microphone audio data x(n) 212 from the time-domain to a frequency-domain. For example, the device 110 may perform Discrete Fourier Transforms (DFTs) (e.g., Fast Fourier transforms (FFTs), short-time Fourier Transforms (STFTs), and/or the like) to generate microphone audio data X(n, k) 214 in the frequency-domain. As used herein, a variable X(n, k) corresponds to the frequency-domain signal and identifies an individual frame associated with frame index n and tone index k. As illustrated in FIG. 2A, the microphone audio data x(t) 212 corresponds to time indexes 216, whereas the microphone audio data x(n) 212 and the microphone audio data X(n, k) 214 corresponds to frame indexes 218.

A Fast Fourier Transform (FFT) is a Fourier-related transform used to determine the sinusoidal frequency and phase content of a signal, and performing FFT produces a one-dimensional vector of complex numbers. This vector can be used to calculate a two-dimensional matrix of frequency magnitude versus frequency. In some examples, the system 100 may perform FFT on individual frames of audio data and generate a one-dimensional and/or a two-dimensional matrix corresponding to the microphone audio data X(n). However, the disclosure is not limited thereto and the system 100 may instead perform short-time Fourier transform (STFT) operations without departing from the disclosure. A short-time Fourier transform is a Fourier-related transform used to determine the sinusoidal frequency and phase content of local sections of a signal as it changes over time.

Using a Fourier transform, a sound wave such as music or human speech can be broken down into its component "tones" of different frequencies, each tone represented by a sine wave of a different amplitude and phase. Whereas a time-domain sound wave (e.g., a sinusoid) would ordinarily be represented by the amplitude of the wave over time, a frequency-domain representation of that same waveform comprises a plurality of discrete amplitude values, where each amplitude value is for a different tone or "bin." So, for example, if the sound wave consisted solely of a pure sinusoidal 1 kHz tone, then the frequency-domain representation would consist of a discrete amplitude spike in the bin containing 1 kHz, with the other bins at zero. In other words, each tone "k" is a frequency index (e.g., frequency bin).

FIG. 2A illustrates an example of time indexes 216 (e.g., microphone audio data x(t) 210) and frame indexes 218 (e.g., microphone audio data x(n) 212 in the time-domain and microphone audio data X(n, k) 216 in the frequency-domain). For example, the system 100 may apply FFT processing to the time-domain microphone audio data x(n) 212, producing the frequency-domain microphone audio data X(n,k) 214, where the tone index "k" (e.g., frequency index) ranges from 0 to K and "n" is a frame index ranging from 0 to N. As illustrated in FIG. 2A, the history of the values across iterations is provided by the frame index "n", which ranges from 1 to N and represents a series of samples over time.

Figure 2B:
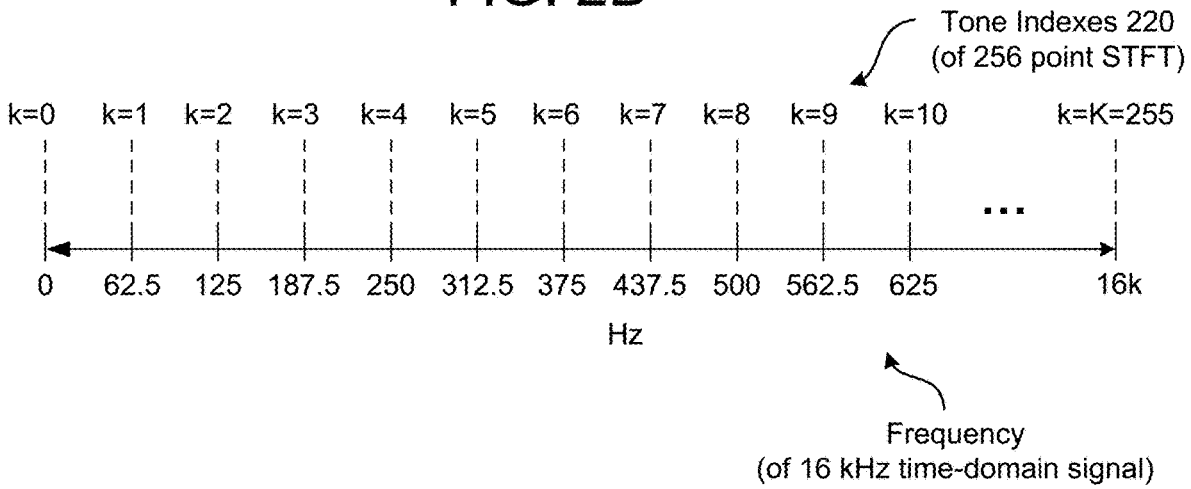

FIG. 2B illustrates an example of performing a K-point FFT on a time-domain signal. As illustrated in FIG. 2B, if a 256-point FFT is performed on a 16 kHz time-domain signal, the output is 256 complex numbers, where each complex number corresponds to a value at a frequency in increments of 16 kHz/256, such that there is 125 Hz between points, with point 0 corresponding to 0 Hz and point 255 corresponding to 16 kHz. As illustrated in FIG. 2B, each tone index 220 in the 256-point FFT corresponds to a frequency range (e.g., subband) in the 16 kHz time-domain signal. While FIG. 2B illustrates the frequency range being divided into 256 different frequency ranges (e.g., tone indexes), the disclosure is not limited thereto and the system 100 may divide the frequency range into K different frequency ranges (e.g., K indicates an FFT size). While FIG. 2B illustrates the tone index 220 being generated using a Fast Fourier Transform (FFT), the disclosure is not limited thereto. Instead, the tone index 220 may be generated using Short-Time Fourier Transform (STFT), generalized Discrete Fourier Transform (DFT) and/or other transforms known to one of skill in the art (e.g., discrete cosine transform, non-uniform filter bank, etc.).

Figure 2C:
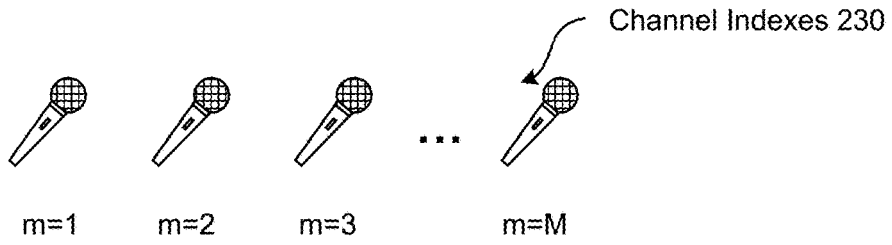

The system 100 may include multiple microphone(s), with a first channel m corresponding to a first microphone (e.g., m=1), a second channel (m+1) corresponding to a second microphone (e.g., m=2), and so on until a final channel (M) that corresponds to final microphone (e.g., m=M). FIG. 2C illustrates channel indexes 230 including a plurality of channels from channel m=1 to channel m=M. While an individual device 110 may include multiple microphone(s), during a communication session the device 110 may select a single microphone and generate microphone audio data using the single microphone. However, while many drawings illustrate a single channel (e.g., one microphone), the disclosure is not limited thereto and the number of channels may vary. For the purposes of discussion, an example of system 100 may include "M" microphones (M≥1) for hands free near-end/far-end distant speech recognition applications.

While FIGS. 2A-2D are described with reference to the microphone audio data $x_m(t)$, the disclosure is not limited thereto and the same techniques apply to the playback audio data $x_r(t)$ without departing from the disclosure. Thus, playback audio data $x_r(t)$ indicates a specific time index t from a series of samples in the time-domain, playback audio data $x_r(n)$ indicates a specific frame index n from series of frames in the time-domain, and playback audio data $X_r(n, k)$ indicates a specific frame index n and frequency index k from a series of frames in the frequency-domain.

Prior to converting the microphone audio data $x_m(n)$ and the playback audio data $x_r(n)$ to the frequency-domain, the device 110 may first perform time-alignment to align the playback audio data $x_r(n)$ with the microphone audio data $x_m(n)$. For example, due to nonlinearities and variable delays associated with sending the playback audio data $x_r(n)$ to loudspeaker(s) using a wired and/or wireless connection, the playback audio data $x_r(n)$ may not be synchronized with the microphone audio data $x_m(n)$. This lack of synchronization may be due to a propagation delay (e.g., fixed time delay) between the playback audio data $x_r(n)$ and the microphone audio data $x_m(n)$, clock jitter and/or clock skew (e.g., difference in sampling frequencies between the device 110 and the loudspeaker(s)), dropped packets (e.g., missing samples), and/or other variable delays.

To perform the time alignment, the device 110 may adjust the playback audio data $x_r(n)$ to match the microphone audio data $x_m(n)$. For example, the device 110 may adjust an offset between the playback audio data $x_r(n)$ and the microphone audio data $x_m(n)$ (e.g., adjust for propagation delay), may add/subtract samples and/or frames from the playback audio data $x_r(n)$ (e.g., adjust for drift), and/or the like. In some examples, the device 110 may modify both the microphone audio data $x_m(n)$ and the playback audio data $x_r(n)$ in order to synchronize the microphone audio data $x_m(n)$ and the playback audio data $x_r(n)$. However, performing nonlinear modifications to the microphone audio data $x_m(n)$ results in first microphone audio data $x_{m1}(n)$ associated with a first microphone to no longer be synchronized with second microphone audio data $x_{m2}(n)$ associated with a second microphone. Thus, the device 110 may instead modify only the playback audio data $x_r(n)$ so that the playback audio data $x_r(n)$ is synchronized with the first microphone audio data $x_{m1}(n)$.

While FIG. 2A illustrates the frame indexes 218 as a series of distinct audio frames, the disclosure is not limited thereto. In some examples, the device 110 may process overlapping audio frames and/or perform calculations using overlapping time windows without departing from the disclosure. For example, a first audio frame may overlap a second audio frame by a certain amount (e.g., 80%), such that variations between subsequent audio frames are reduced. Additionally or alternatively, the first audio frame and the second audio frame may be distinct without overlapping, but the device 110 may determine power value calculations using overlapping audio frames. For example, a first power value calculation associated with the first audio frame may be calculated using a first portion of audio data (e.g., first audio frame and n previous audio frames) corresponding to a fixed time window, while a second power calculation associated with the second audio frame may be calculated using a second portion of the audio data (e.g., second audio frame, first audio frame, and n−1 previous audio frames) corresponding to the fixed time window. Thus, subsequent power calculations include n overlapping audio frames.

Figure 2D:
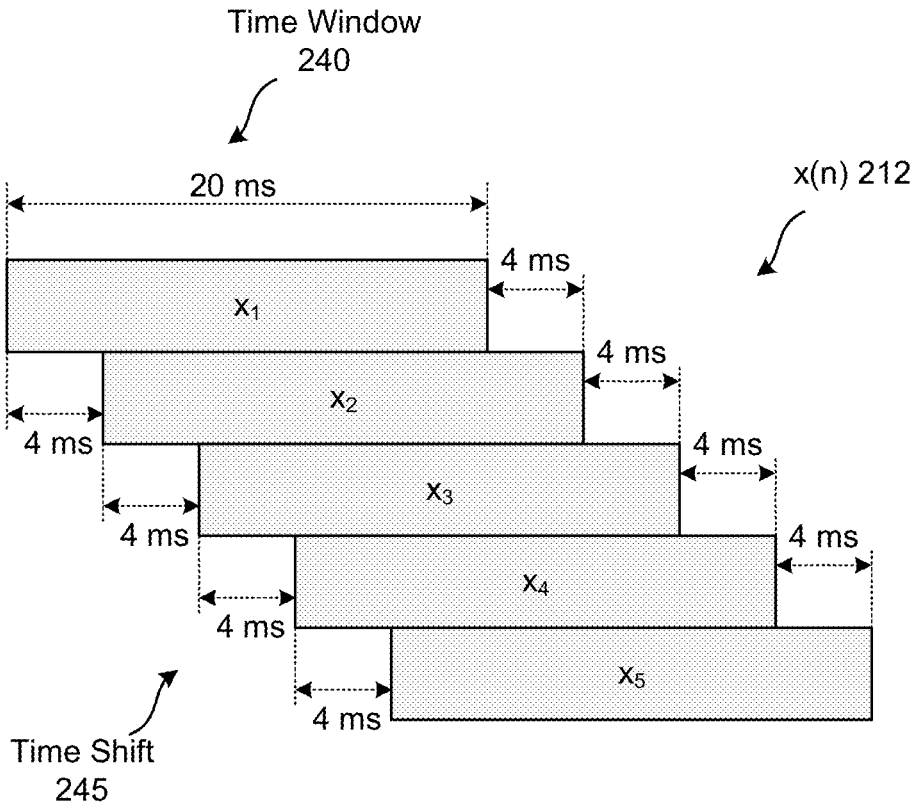

As illustrated in FIG. 2D, overlapping audio frames may be represented as overlapping audio data associated with a time window 240 (e.g., 20 ms) and a time shift 245 (e.g., 4 ms) between neighboring audio frames. For example, a first audio frame x1 may extend from 0 ms to 20 ms, a second audio frame x2 may extend from 4 ms to 24 ms, a third audio frame x3 may extend from 8 ms to 28 ms, and so on. Thus, the audio frames overlap by 80%, although the disclosure is not limited thereto and the time window 240 and the time shift 245 may vary without departing from the disclosure.

Figure 3A:
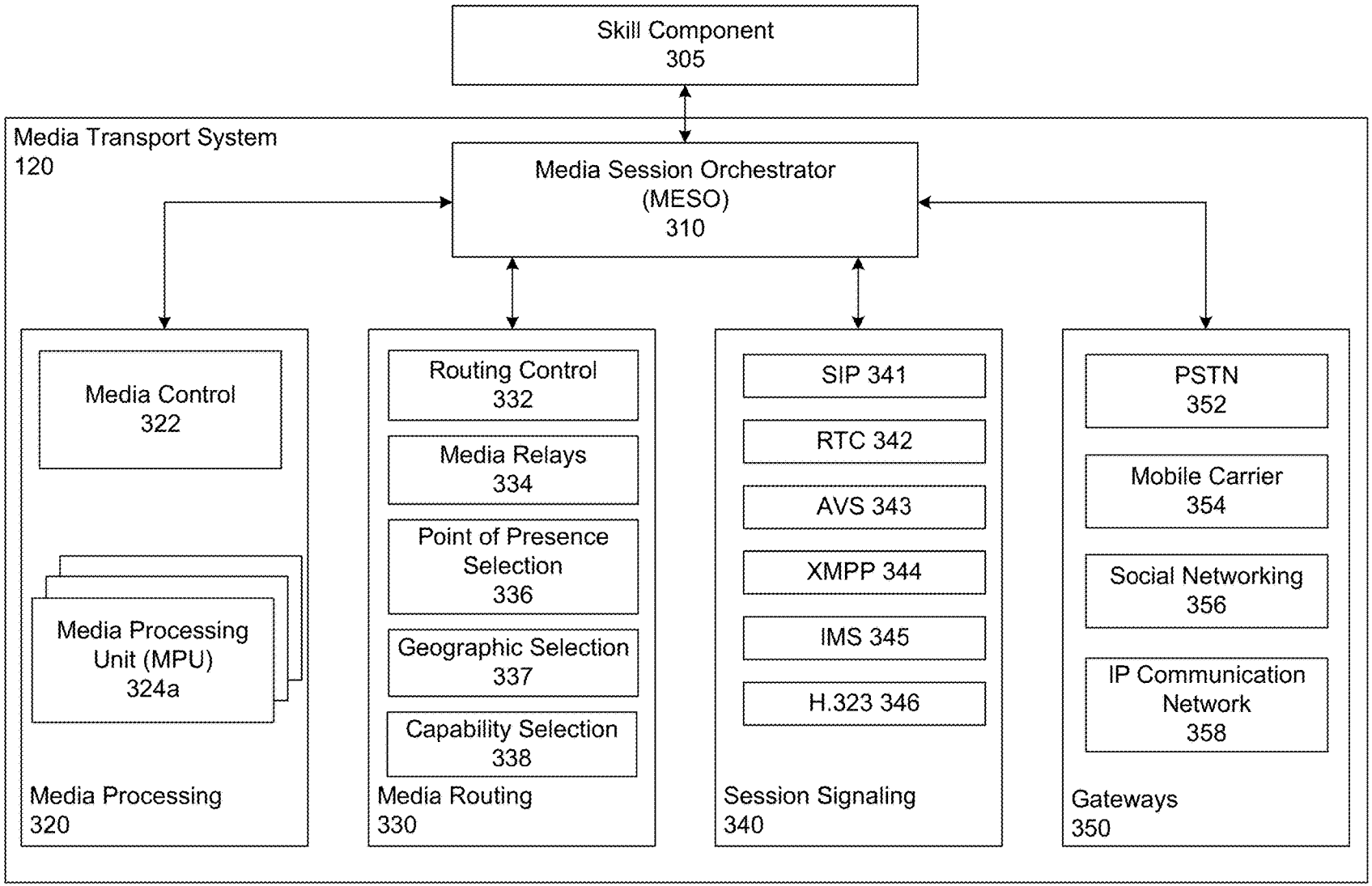
FIGS. 3A-3B illustrate example component diagrams of a media transport system configured to perform media processing according to embodiments of the present disclosure.
Figure 3B:
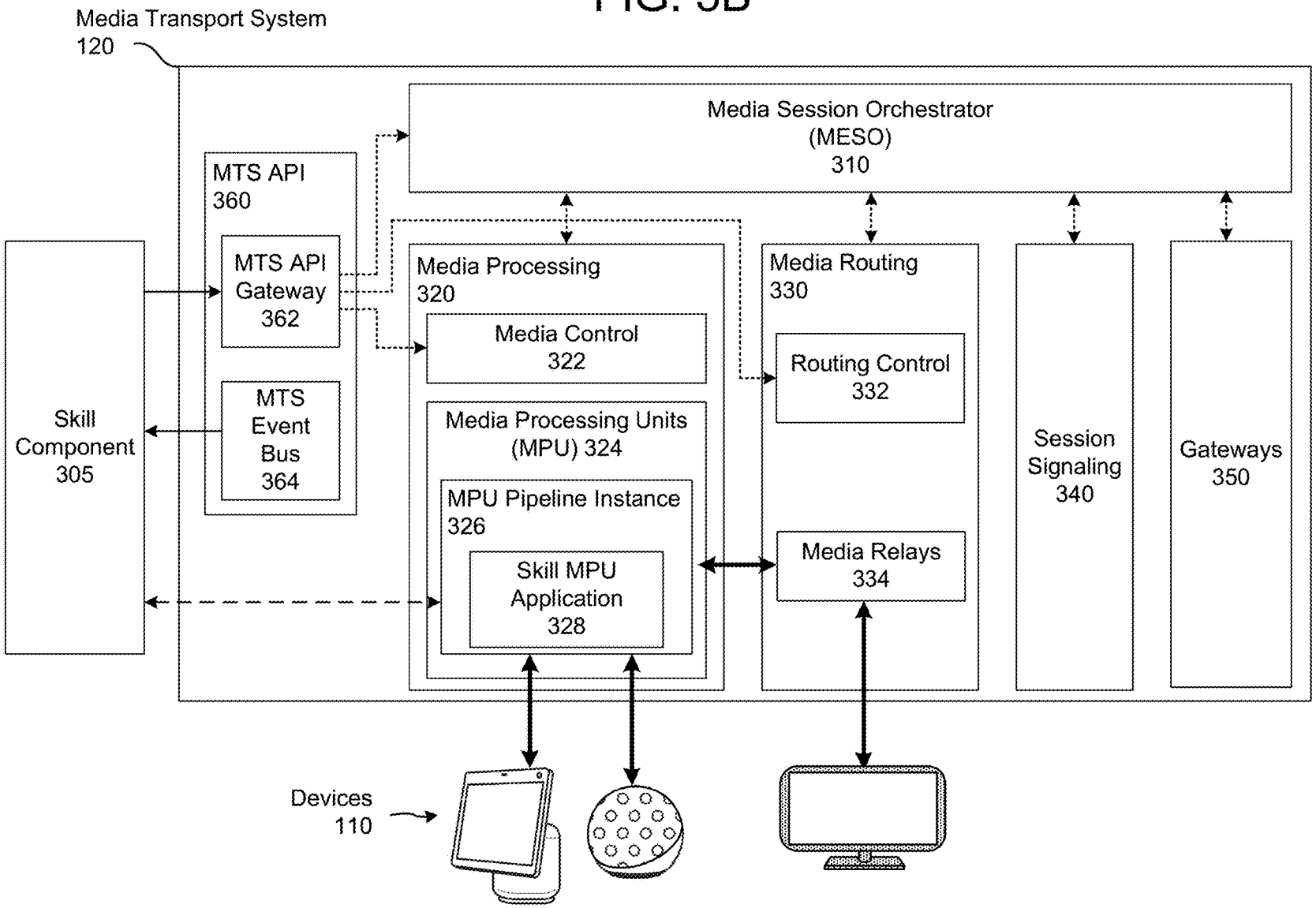

FIGS. 3A-3B illustrate example component diagrams of a media transport system configured to perform media processing according to embodiments of the present disclosure. As illustrated in FIG. 3A, a skill component 305 (e.g., specific skill configured to support communication sessions on the device 110) may interact with a media transport system 120 to request and utilize resources available within the media transport system 120. For example, the skill component 305 may correspond to an application (e.g., process, skill, and/or the like) running on a local device (e.g., device 110) and/or one or more servers, and the skill component 305 may enable a user 5 to interact with the media transport system 120 to initiate and manage a communication session involving media processing, although the disclosure is not limited thereto. To illustrate an example, the user 5 may input a command to an application programming interface (API) for the skill component 305 that is running on the device 110. The device 110 may send a request corresponding to the command to the one or more servers associated with the skill component 305 and the one or more servers may send the request to the media transport system 120.

In some examples, the skill component 305 may be developed (e.g., programmed) by an internal client or other development team (e.g., developer, programmer, and/or the like) to perform specific functionality. Thus, the skill component 305 may be designed to utilize specific resources available within the media transport system 120 and a finished product is made available to the public (e.g., end-user such as user 5). For example, the skill component 305 may enable the user 5 to initiate and/or participate in a communication session (e.g., group conference call, such as videoconferencing), to consume media content (e.g., streaming video data) with unique functionality or processing, and/or perform additional functionality (e.g., perform computer vision processing on image data, speech processing on audio data, machine learning, and/or the like) without departing from the disclosure. In this example, the media transport system 120 provides a simplified interface that enables the internal client to utilize resources within the skill component 305, but the interface and/or resources are not visible to and/or customizable by the end-user that uses the skill component 305.

The disclosure is not limited thereto, however, and in other examples the skill component 305 may be made available for external development to third party clients and/or to individual users. Thus, the media transport system 120 may provide a simplified interface for unique programming without technical expertise. For example, an individual user 5 may customize the skill component 305 using a drag and drop graphical user interface (GUI) to enable unique functionality, enabling the user 5 to program custom routines, skills, and/or the like. To illustrate an example, the user 5 may customize the skill component 305 to receive image data generated by an image sensor, process the image data using computer vision, and then perform specific action(s). For example, the skill component 305 may be programmed so that when a device (e.g., doorbell camera) detects motion and captures image data, the skill component 305 processes the image data using facial recognition to detect authorized users (e.g., family members or other invited guests) and either performs a first action (e.g., unlock the front door when an authorized user is detected) or performs a second action (e.g., send a notification to the user 5 including image data representing an unauthorized user).

Thus, the interface and/or resources associated with the media transport system 120 may be visible to and/or customizable by the end-user that uses the skill component 305 without departing from the disclosure.

To enable the skill component 305 to request and utilize resources from within the media transport system 120, the media transport system 120 may include a media session orchestrator (MESO) component 310 configured to coordinate (e.g., define, establish, manage, etc.) a communication session (e.g., media session).

As illustrated in FIG. 3A, the MESO component 310 may interface between components that fall within four distinct categories: media processing components 320, media routing components 330, session signaling components 340, and/or gateway components 350.

Media processing components 320 refers to processing media content to enable unique functionality. For example, the media transport system 120 may provide a hosted back-end that performs media processing on individual streams of data, enabling the skill component 305 to define and control how media content is processed by the media transport system 120. The media processing components 320 may correspond to real time processing (e.g., data is processed during run-time, such as while streaming video to a user 5, during a videoconference, and/or the like) or offline processing (e.g., data is processed and stored in a database for future requests, such as during batch processing) without departing from the disclosure.

The media processing components 320 may include at least one media control component 322 and/or at least one media processing unit (MPU) 324 (e.g., first MPU 324*a*, second MPU 324*b*, etc.). The media control component 322 may coordinate media processing by sending control data to and/or receiving control data from other components within the media transport system 120. For example, the MESO component 310 may send a request to the media control component 322 to launch a specific application (e.g., skill, process, etc.) to perform media processing and the media control component 322 may send an instruction to a corresponding MPU 324.

The MPU 324 may be configured to perform media processing to enable additional functionality. Thus, the MPU 324 may receive first data and process the first data to generate second data. As part of performing media processing, the MPU 324 may perform speech processing on audio data and/or image data, perform computer vision processing on image data, modify audio data and/or image data, apply visual effects (e.g., overlay or other graphical element(s)) to image data, and/or the like to enable interesting functionality without departing from the disclosure. For example, the MPU 324 may generate subtitles (e.g., text data) corresponding to speech represented in image data, may translate the subtitles to a different language, may perform text-to-speech processing to enable additional functionality (e.g., describing visual cues for someone that is visually impaired, replacing dialog with speech in a different language, etc.), may perform voice recognition to identify voices represented in audio data, may perform facial recognition to detect and/or identify faces represented in image data, may perform object recognition to detect and/or identify objects represented in image data, may add a graphical overlay to image data (e.g., censoring portions of the image data, adding symbols or cartoons to the image data, etc.), may perform other processing to media content (e.g., colorize black and white movies), and/or the like without departing from the disclosure.

In some examples, the media transport system 120 may perform media processing using two or more MPUs 324. For example, the media transport system 120 may perform first media processing using a first MPU 324*a* and perform second media processing using a second MPU 324*b*. To illustrate an example, a communication session may correspond to a video chat implementation that includes image data and audio data and the media transport system 120 may perform media processing in parallel. For example, the media transport system 120 may separate the image data and the audio data, performing first media processing on the image data and separately performing second media processing on the audio data, before combining the processed image data and the processed audio data to generate output data. However, the disclosure is not limited thereto, and in other examples the media transport system 120 may perform media processing in series without departing from the disclosure. For example, the media transport system 120 may process first image data using the first MPU 324*a* (e.g., first media processing) to generate second image data and may process the second image data using the second MPU 324*b* (e.g., second media processing) to generate output image data. Additionally or alternatively, the media transport system 120 may perform multiple media processing steps using a single MPU 324 (e.g., more complex media processing) without departing from the disclosure.

The media transport system 120 may include media routing components 330 that are configured to route media (e.g., send data packets) to and from the device(s) 110 via the network(s) 199. For example, the media routing components 330 may include one or more routing control components 332, media relay components 334, point of presence selection components 336, geographic selection components 337, and/or capability selection components 338. Examples of media relay components may include a Session Traversal of User Datagram Protocol (UDP) Through Network Address Translators (NATs) system (e.g., STUN system) and/or a Traversal Using relays around NAT (TURN) system, although the disclosure is not limited thereto. While FIG. 3A illustrates the media routing components 330 including the point of presence selection components 336, geographic selection components 337, and/or capability selection components 338 as separate components, this is for ease of illustration and the disclosure is not limited thereto. Instead, a single component may perform point of presence selection, geographic selection, and/or capability selection without departing from the disclosure.

In some examples, the media transport system 120 may separate the MPUs 324 from the network(s) 199 so that the MPUs 324 do not have a publicly accessible internet protocol (IP) address (e.g., cannot route outside of a local network). Thus, the system 100 may use the media relay components 334 to send the first data from a first device to the MPUs 324 and/or the second data (e.g., processed data) generated by the MPUs 324 from the MPUs 324 to a second device. For example, an individual device 110 may be associated with a specific TURN server, such that the system 100 may route data to and from the first device using a first TURN server and route data to and from the second device using a second TURN server.

While the example described above illustrates routing data to and from the media processing components 320, the media routing components 330 may be used to route data separately from the media processing components 320 without departing from the disclosure. For example, the system 100 may route data directly between devices 110 using one or more TURN servers (e.g., TURN system) without departing from the disclosure. Additionally or alternatively, the system 100 may route data using one or more STUN servers (e.g., STUN system), such as when a device 110 has a publicly accessible IP address. In some examples, the system may establish communication sessions using a combination of the STUN system and the TURN system without departing from the disclosure. For example, a communication session may be more easily established/configured using the TURN system, but may benefit from latency improvements using the STUN system. Thus, the system 100 may route data using the STUN system, the TURN system, and/or a combination thereof without departing from the disclosure.

In addition to routing data, the media routing components 330 also perform topology optimization. For example, the media routing components 330 may include geographically distributed media relay components (e.g., TURN/STUN servers) to enable the media transport system 120 to efficiently route the data packets. For example, the media routing components 330 may include a control plane that coordinates between the media relay components to select an optimum route (e.g., data path) to send the data packets. To illustrate an example, the media routing components 330 may determine a location of parties in a communication session and determine a data path that bypasses a particular country or chokepoint in the data network. In some examples, the media routing components 330 may select an enterprise specific route and only use specific connected links associated with the enterprise. Additionally or alternatively, the routing components 330 may apply machine learning models to further reduce latency by selecting the optimum route using non-geographical parameters (e.g., availability of servers, time of day, previous history, etc.).

While the description of the media relay components 334 refers to the STUN system and/or the TURN system, the disclosure is not limited thereto. Instead, the media routing components 330 may use any alternative systems known to one of skill in the art to route the data packets. For example, the media routing components 330 may use any technique that routes UDP data packets and allows the UDP data packets to traverse the NATs without departing from the disclosure. To illustrate an example, the media routing components 330 may include UDP packet forwarding and relay devices instead of the TURN system without departing from the disclosure.

The media transport system 120 may include session signaling components 340 (e.g., edge signaling, signaling network, etc.) that may be configured to coordinate signal paths (e.g., routing of data packets) and/or a type of data packets sent between the devices 110 and server(s) within the media transport system 120. For example, the session signaling components 340 may enable the devices 110 to coordinate with each other to determine how data packets are sent between the devices 110. In some examples, a signal path may correspond to a routing table that indicates a particular route or network addresses with which to route data between two devices, although the disclosure is not limited thereto. As illustrated in FIG. 3A, the session signaling components 340 may support protocols including Session Initiation Protocol (SIP) 341, Real-Time Communication (RTC) protocol 342 (e.g., WebRTC protocol), Alexa Voice Service (AVS) protocol 343 or other voice user interface protocols, Extensible Messaging and Presence Protocol (XMPP) 344, IP Multimedia Core Network Subsystem (IMS) 345, H.323 standard 346, and/or the like, although the disclosure is not limited thereto.

The media transport system 120 may include gateway components 350 that enable the media transport system 120 to interface with (e.g., send/receive media content or other data) external networks. As illustrated in FIG. 3A, the gateway components 350 may include a public switched telephone network (PSTN) gateway 352, a mobile carrier gateways 354, a social networking gateway 356, an IP communication network gateway 358, and/or other gateways known to one of skill in the art. While FIG. 3A illustrates the gateway components 350 including a single gateway for each external network, this is intended for illustrative purposes only and the gateway components 350 may include multiple gateways for each external network without departing from the disclosure. For example, the gateway components 350 may include multiple PSTN gateways 352 having different locations without departing from the disclosure. Additionally or alternatively, a single type of external network may correspond to multiple external networks without departing from the disclosure. For example, the gateway components 350 may include a first mobile carrier gateway 354 corresponding to a first mobile carrier network and a second mobile carrier gateway 354*b* corresponding to a second mobile carrier network without departing from the disclosure. However, the disclosure is not limited thereto and two or more mobile carrier networks may share a mobile carrier gateway 354 without departing from the disclosure.

To illustrate an example of using the gateway components 350, the system 100 may use the PSTN gateway 352 to establish a communication session with a PSTN device (e.g., wired/wireless telephone, cellular phone, and/or the like that is associated with a PSTN telephone number) using the PSTN. For example, the system 100 may use the session signaling components 340 to send SIP data packets from a device 110 to a PSTN gateway 352. The PSTN gateway 352 may receive the SIP data packets, convert the SIP data packets to audio data in a different format, and send the audio data to the PSTN device via the PSTN. Thus, the gateway components 350 may include a plurality of gateways, with each gateway being associated with a specific external network and configured to act as an interface between the media transport system 120 and the external network.

FIG. 3B illustrates an example of signal paths and data flow between components within the media transport system 120. As illustrated in FIG. 3B, the skill component 305 may send data to a media transport system (MTS) application programming interface (API) 360. The MTS API 360 may include an MTS API gateway component 362 that receives the data (e.g., request) and sends data to the MESO component 310, the media processing components 320, the media routing components 330, and/or other components. For example, FIG. 3B illustrates the MTS API gateway component 362 communicating with the MESO component 310, the media control component 322, and the routing control component 332.

As described above with regard to FIG. 3A, the MESO component 310 may communicate with the media processing components 320, the media routing components 330, the session signaling components 340, and/or the gateway components 350. Internal signaling within the media transport system 120 is represented in FIG. 3B as dotted lines.

The components within the media transport system 120 may process the request received from the MTS API gateway 362 and send data to the MTS API 360 in response to processing the request. For example, components within the media transport system 120 may send data to an MTS event bus 364 of the MTS API 360 and the MTS event bus 364 may send data (e.g., event, notification, etc.) to the skill component 305. Data sent as part of the MTS interface between the skill component 305 and the media transport system 120 is represented in FIG. 3B using a solid line.

As illustrated in FIG. 3B, the skill component 305 may communicate with the MPU 324. For example, the skill component 305 may communicate with an MPU pipeline instance 326 running within the MPU 324 that includes a skill MPU application 328. Thus, the skill component 305 may communicate directly with the skill MPU application as part of an application interface, which is represented as a dashed line in FIG. 3B. In addition to communicating with the skill component 305, the MPU pipeline instance 326 may send data (e.g., media content) to the devices 110, either directly or via the media relay components 334.

As used herein, an MPU pipeline instance or any other instance may refer to a specific component that is executing program code; all of the logic associated with the media processing unit is running in memory in a single host, which decreases latency associated with the media processing. For example, conventional techniques for executing asynchronous workflows perform checkpointing to store data in storage components between events. Thus, when a new event occurs, the conventional techniques retrieve the stored session and loads data into the memory, resulting in a large amount of latency. As part of reducing the latency, the media transport system 120 may use the MESO component 310 to route triggers and events directly to the MPU pipeline instance that is performing the media processing, enabling the media transport system 120 to perform media processing in real-time.

Using the MESO component 310, the media transport system 120 allows skills and/or applications to enable unique functionality without requiring the skill/application to independently develop and/or program the functionality. Thus, the media transport system 120 may offer media processing operations as a service to existing skills/applications. For example, the media transport system 120 may enable a skill to provide closed captioning or other features without building a closed captioning service. Instead, the media transport system 120 may route a communication session through an MPU 324 configured to perform closed captioning. Thus, an MPU 324 configured to enable a specific feature may be utilized to enable the feature on multiple skills without departing from the disclosure.

As the MESO component 310 is capable of executing requests and commands with low latency, the media transport system 120 may utilize multiple components within a single communication session. For example, the media transport system 120 may combine multiple different components (e.g., MPUs 324 associated with one or more skills) to piece together a custom implementation enabling a combination of existing features. To illustrate an example, the media transport system 120 may build back to back SIP user engine that is customizable for a specific implementation. Thus, the MESO component 310 may mix and match different components and/or features to provide a customized experience.

Figure 4A:
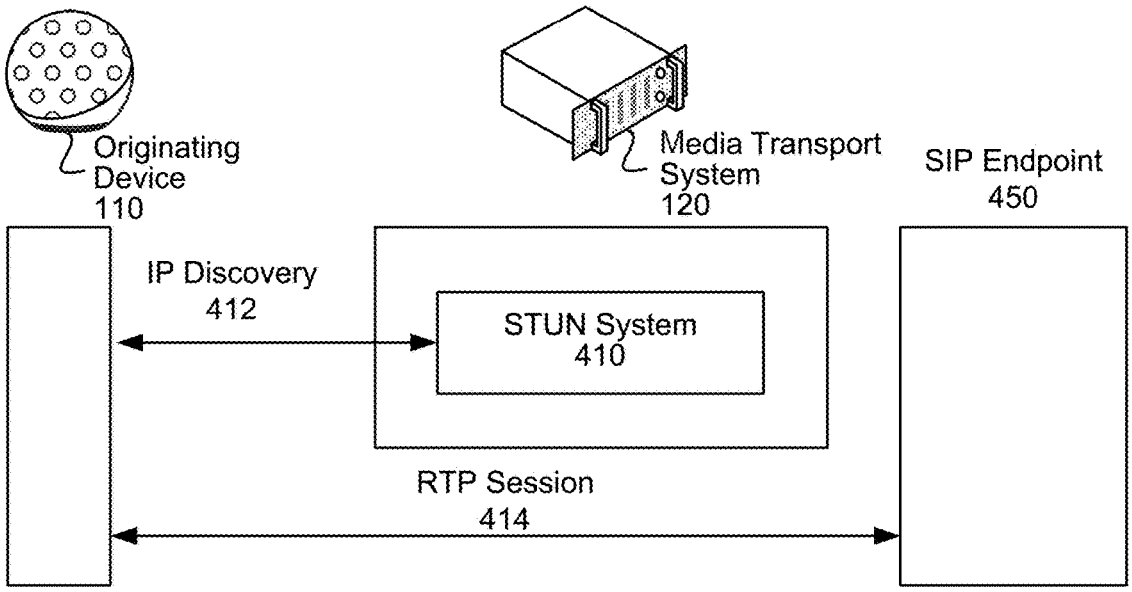
FIGS. 4A-4B illustrate examples of establishing media connections between devices according to embodiments of the present disclosure.
Figure 4B:
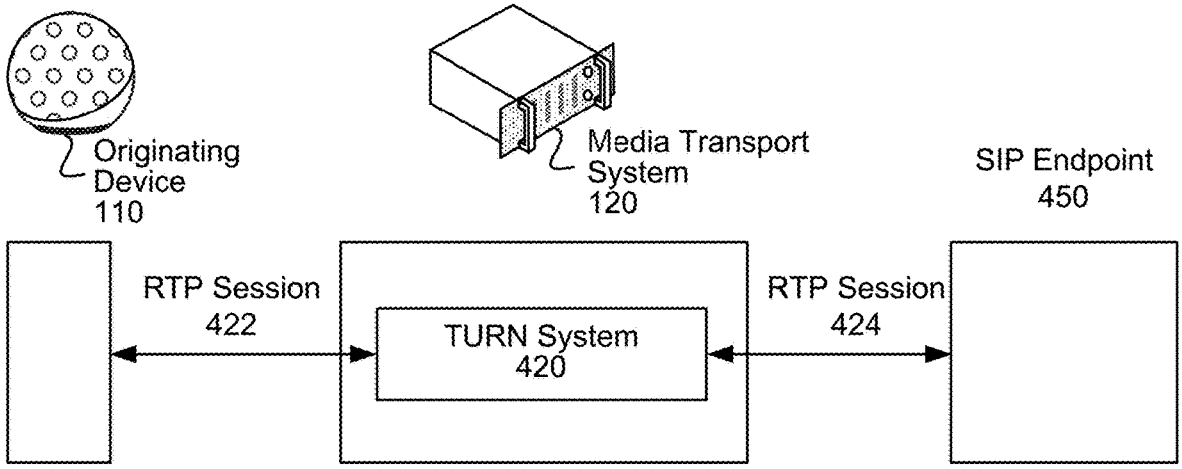

FIGS. 4A-4B illustrate examples of establishing media connections between devices according to embodiments of the present disclosure. In some examples, an originating device 110 may have a publicly accessible IP address and may be configured to establish a real-time transport (RTP) protocol communication session directly with a SIP endpoint 450. The SIP endpoint 450 may correspond to a device 110, a component within the media transport system 120, a gateway component configured to interface with a remote network, and/or a device associated with the remote network itself. To enable the originating device 110 to establish the RTP communication session, the media transport system 120 may include Session Traversal of User Datagram Protocol (UDP) Through Network Address Translators (NATs) system (e.g., STUN system 410). The STUN system 410 may be configured to allow NAT clients (e.g., an originating device 110 behind a firewall) to setup calls to a Voice over Internet Protocol (VoIP) provider hosted outside of the local network by providing a public IP address, the type of NAT they are behind, and a port identifier associated by the NAT with a particular local port. As illustrated in FIG. 4A, the originating device 110 may perform (412) IP discovery using the STUN system 410 and may use this information to set up an RTP communication session 414 (e.g., UDP communication) between the originating device 110 and the SIP endpoint 450 to establish a call.

In some examples, the originating device 110 may not have a publicly accessible IP address. For example, in some types of NAT the originating device 110 cannot route outside of the local network. To enable the originating device 110 to establish an RTP communication session, the media transport system 120 may include Traversal Using relays around NAT (TURN) system 420. The TURN system 420 may be configured to connect the originating device 110 to the SIP endpoint 450 when the originating device 110 is behind a NAT. As illustrated in FIG. 4B, the originating device 110 may establish (422) an RTP session with the TURN system 420 and the TURN system 420 may establish (424) an RTP session with the SIP endpoint 450. Thus, the originating device 110 may communicate with the SIP endpoint 450 via the TURN system 420. For example, the originating device 110 may send audio data and/or image data to the media transport system 120 and the media transport system 120 may send the audio data and/or the image data to the SIP endpoint 450. Similarly, the SIP endpoint 450 may send audio data and/or image data to the media transport system 120 and the media transport system 120 may send the audio data and/or the image data to the originating device 110.

In some examples, the system may establish communication sessions using a combination of the STUN system 410 and the TURN system 420 without departing from the disclosure. For example, a communication session may be more easily established/configured using the TURN system 420, but may benefit from latency improvements using the STUN system 410. Thus, the system may use the STUN system 410 when the communication session may be routed directly between two devices and may use the TURN system 420 for all other communication sessions. Additionally or alternatively, the system may use the STUN system 410 and/or the TURN system 420 selectively based on the communication session being established. For example, the system may use the STUN system 410 when establishing a communication session between two devices (e.g., point-to-point) within a single network (e.g., corporate LAN and/or WLAN), but may use the TURN system 420 when establishing a communication session between two devices on separate networks and/or three or more devices regardless of network(s).

When the communication session goes from only two devices to three or more devices, the system may need to transition from the STUN system 410 to the TURN system 420. Thus, if the system anticipates three or more devices being included in the communication session, the communication session may be performed using the TURN system 420. Similarly, when the communication session goes from three or more devices to only two devices, the system may need to transition from the TURN system 420 to the STUN system 410.

While FIGS. 4A-4B illustrate an RTP communication session being established between the originating device 110 and the SIP endpoint 450, the present disclosure is not limited thereto and the RTP communication session may be established between the originating device 110 and a gateway component or other device associated with the SIP endpoint 450 without departing from the present disclosure. Additionally or alternatively, while FIGS. 4A-4B illustrate examples of enabling communication sessions using the SIP protocol, the disclosure is not limited thereto and the media transport system 120 may use any protocols known to one of skill in the art.

While FIGS. 4A-4B illustrate examples of enabling communication sessions using a data connection (e.g., using Voice over Internet Protocol (VoIP), session initiation protocol (SIP), and/or the like), the disclosure is not limited thereto and the system 100 may enable communication sessions using any type of network without departing from the disclosure. For example, the media transport system 120 may enable communication sessions using a cellular connection (e.g., mobile phone network) or other external network without departing from the disclosure. For example, the media transport system 120 may send instructions (e.g., command data) to endpoints (e.g., caller devices, such as the device 110) instructing the endpoint to establish a communication session (e.g., dial a telephone number) in response to the voice command.

Figure 5A:
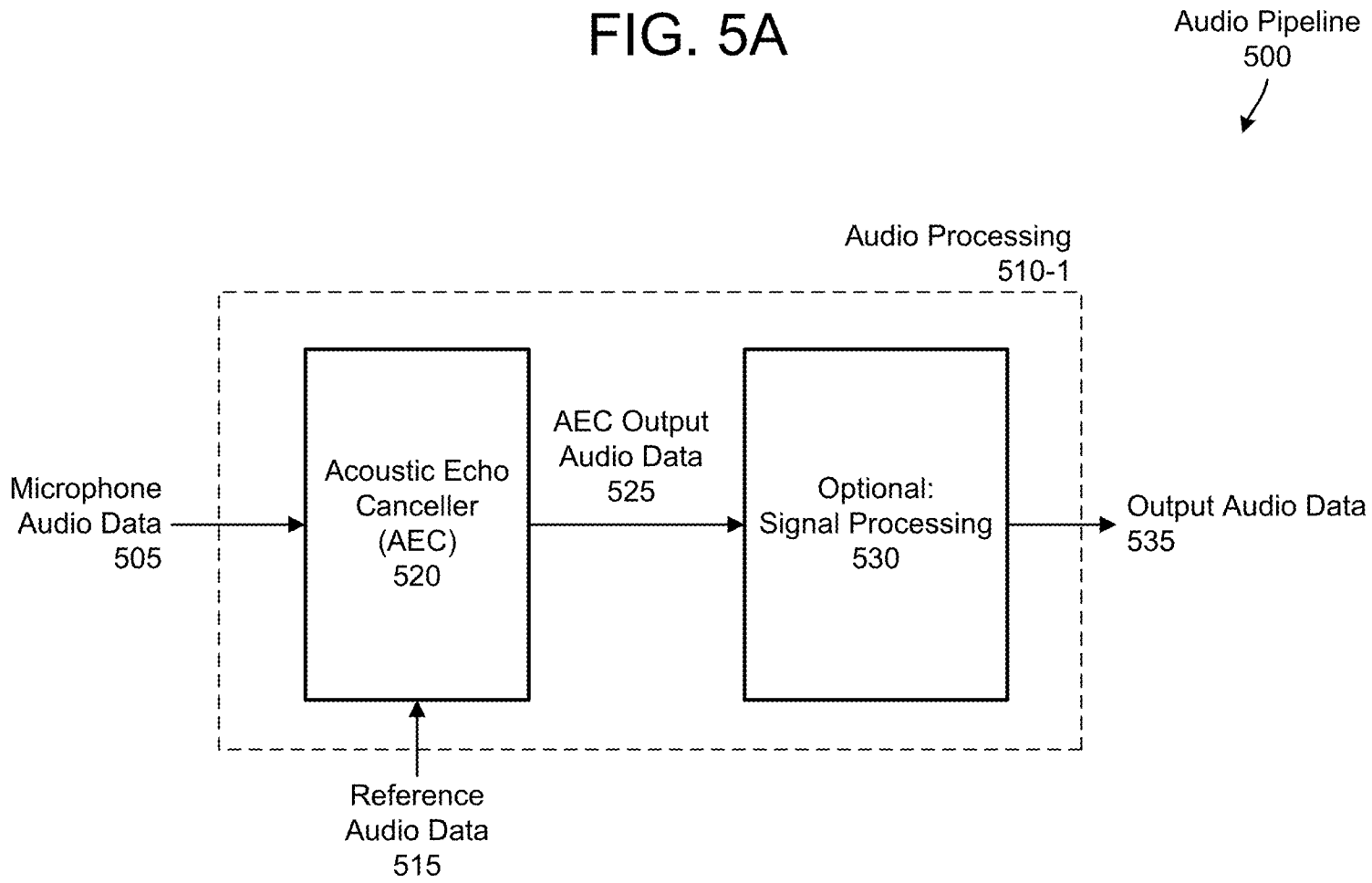
FIGS. 5A-5B illustrate example component diagrams for performing audio processing according to embodiments of the present disclosure.
Figure 5B:
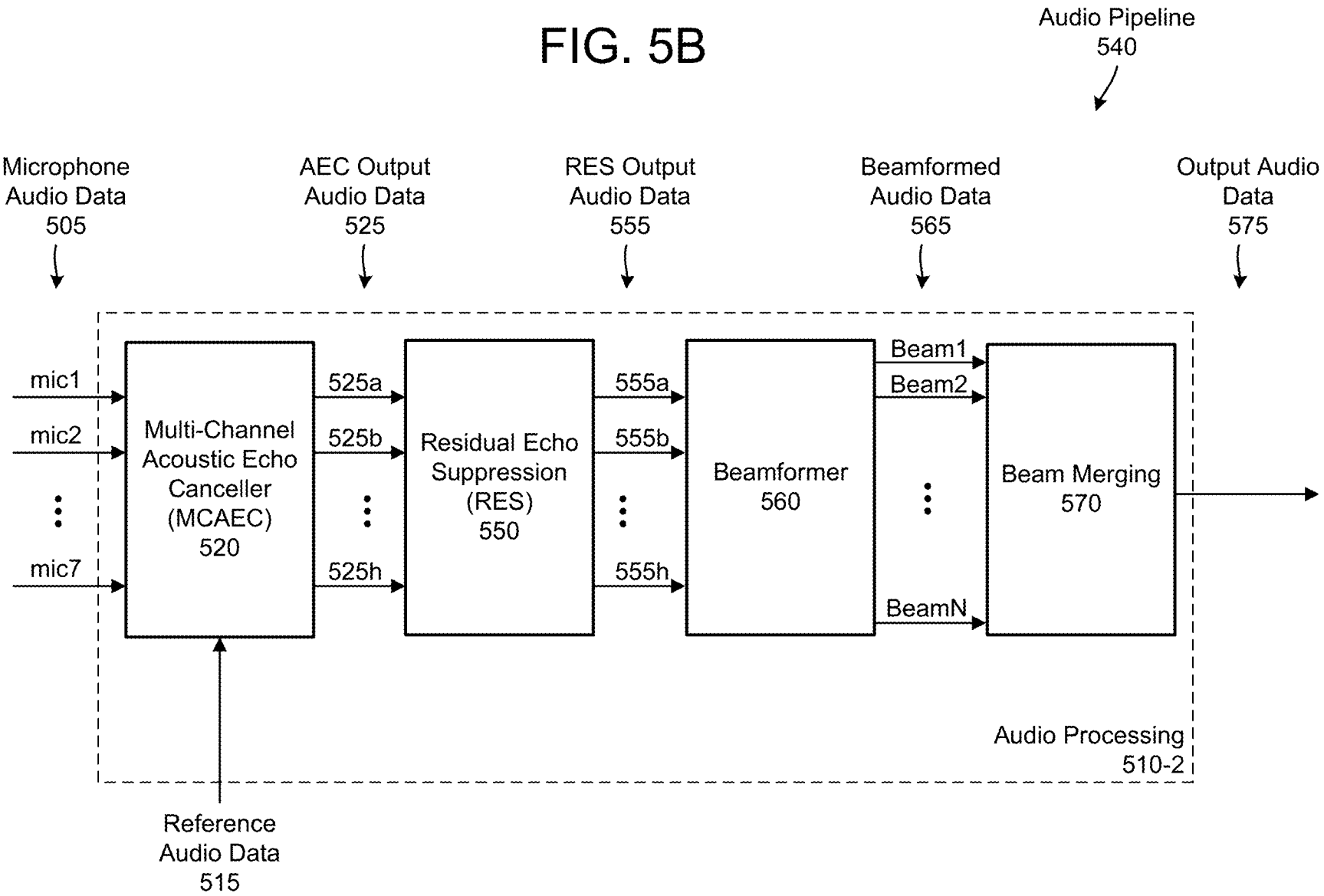

FIGS. 5A-5B illustrate example component diagrams for performing audio processing according to embodiments of the present disclosure. In some examples, the device 110 may perform audio processing differently depending on whether the device 110 is performing speech processing (e.g., determining an action responsive to a voice command) or capturing audio during a communication session, such as a Voice over Internet Protocol (VoIP) communication session. For example, during speech processing, the device 110 may process audio data generated by multiple microphones 112 and perform beamforming to generate directional audio data corresponding to individual direction(s) associated with the user. In contrast, during the communication session the device 110 may process audio data generated by a single microphone and perform other signal processing without performing beamforming. However, the disclosure is not limited thereto, and in some examples the device 110 may perform beamforming during the communication session without departing from the disclosure.

As illustrated in FIG. 5A, a simple audio pipeline 500 may include first audio processing components 510-1 configured to perform echo cancellation and optionally perform additional signal processing. For example, the first audio processing components 510-1 may include an acoustic echo canceller (AEC) component 520 configured to perform echo cancellation to remove an echo signal from the microphone audio data. After performing echo cancellation, the first audio processing components 510-1 may include optional signal processing components 530 configured to perform additional signal processing, such as residual echo suppression (RES) processing, noise reduction (NR) processing, fixed beamforming (FBF) processing, adaptive beamforming (ABF) processing, and/or the like, although the disclosure is not limited thereto.

As illustrated in FIG. 5A, the AEC component 520 may receive microphone audio data 505 from the microphone(s) 112 and may be configured to perform echo cancellation to generate AEC output audio data 525. For example, the AEC component 520 may determine a reference signal and may perform echo cancellation by subtracting the reference signal from the microphone audio data 505 to generate the AEC output audio data 525.

In some examples, the reference signal may correspond to playback audio data used to generate output audio during the communication session. For example, the first device 110*a* may receive the playback audio data from the second device 110*b* and may generate output audio by sending the playback audio data to one or more loudspeaker(s) 114 associated with the first device 110*a*. Thus, the AEC component 520 may receive the playback audio data (e.g., reference audio data 515) and may use adaptive filters to generate the reference signal, which corresponds to an estimated echo signal represented in the microphone audio data 505. By subtracting the reference signal from the microphone audio data 505, the AEC component 520 may remove at least a portion of the echo signal and isolate local speech represented in the microphone audio data 505.

However, the disclosure is not limited thereto and in other examples the AEC component 520 may perform echo cancellation using other techniques without departing from the disclosure. For example, the AEC component 520 may receive second microphone audio data generated by a second microphone and may generate a reference signal using the second microphone audio data without departing from the disclosure. Thus, the AEC component 520 may perform acoustic echo cancellation (AEC), adaptive interference cancellation (AIC) (e.g., acoustic interference cancellation), adaptive noise cancellation (ANC), and/or the like without departing from the disclosure.

In some examples, the AEC output audio data 525 may correspond to the output audio data 535 without any additional signal processing. However, the disclosure is not limited thereto, and in other examples the optional signal processing components 530 may be configured to perform additional signal processing on the AEC output audio data 525 to generate the output audio data 535 without departing from the disclosure. For example, the optional signal processing components may be configured to perform residual echo suppression (RES) processing, noise reduction (NR) processing, fixed beamforming (FBF) processing, adaptive beamforming (ABF) processing, and/or the like, although the disclosure is not limited thereto.

As illustrated in FIG. 5B, a complex audio pipeline 540 may include second audio processing components 510-2 configured to perform echo cancellation and additional signal processing, such as residual echo suppression processing and beamforming, although the disclosure is not limited thereto. For example, the second audio processing components 510-2 may include the AEC component 520, an RES component 550, a Beamformer component 560, and a beam merging component 570. However, the disclosure is not limited thereto, and the audio pipeline 540 may include additional components and/or fewer components without departing from the disclosure. Additionally or alternatively, the sequence of the components may vary without departing from the disclosure. For example, the Beamformer component 560 may be located prior to the AEC component 520 within the audio pipeline 540 without departing from the disclosure.

As the audio pipeline 540 is configured to process microphone audio data 505 generated by multiple microphones, the AEC component 520 is illustrated as a multi-channel acoustic echo canceller (MCAEC) component 520. For example, the MCAEC component 520 may receive microphone audio data 505 (e.g., microphone audio data $x_m(t)$) from two or more microphone(s) 112 and may perform echo cancellation individually for each of the microphones 112. Thus, the microphone audio data 505 may include an individual channel for each microphone, such as a first channel mic1 associated with a first microphone 112*a*, a second channel mic2 associated with a second microphone 112*b*, and so on until a seventh channel mic7 associated with a seventh microphone 112*g*. While FIG. 5B illustrates 7 unique microphones 112, the disclosure is not limited thereto and the number of microphones 112 may vary without departing from the disclosure.

Similarly, the MCAEC component 520 may receive reference audio data 515 (e.g., playback audio data $x_r(t)$) associated with one or more loudspeakers 114 of the device 110. In some examples, the reference audio data 515 may correspond to a single loudspeaker 114, such that the reference audio data 515 only includes a single channel. However, the disclosure is not limited thereto, and in other examples the reference audio data 515 may correspond to multiple loudspeakers 114 without departing from the disclosure. For example, the reference audio data 515 may include five separate channels, such as a first channel corresponding to a first loudspeaker 114*a* (e.g., woofer), a second channel corresponding to a second loudspeaker 114*b* (e.g., tweeter), and three additional channels corresponding to three additional loudspeakers 114*c*-114*e* (e.g., midrange) without departing from the disclosure. The disclosure is not limited thereto, however, and the number of loudspeakers may vary without departing from the disclosure.

The MCAEC component 520 may perform echo cancellation by subtracting the reference audio data 515 from the microphone audio data 505 to generate AEC output audio data 525. For example, the MCAEC component 520 may generate a first channel of AEC output audio data 525*a* corresponding to the first microphone 112*a*, a second channel of AEC output audio data 525*b* corresponding to the second microphone 112*b*, and so on. Thus, the device 110 may process the individual channels separately.

As illustrated in FIG. 5B, in some examples the second audio processing components 510-2 may include a RES component 550 configured to perform residual echo suppression processing to generate RES output audio data 555. For example, the RES component 550 may generate a first channel of RES output audio data 555*a* corresponding to the first microphone 112*a*, a second channel of RES output audio data 555*b* corresponding to the second microphone 112*b*, and so on. While FIG. 5B illustrates the RES component 550 as a single component, the disclosure is not limited thereto and the RES component 550 may comprise multiple RES components without departing from the disclosure. For example, a first RES component 550*a* may generate the first channel of RES output audio data 555*a* corresponding to the first microphone 112*a*, a second RES component 550*b* may generate the second channel of RES output audio data 555*b* corresponding to the second microphone 112*b*, and so on.

In some examples, the second audio processing components 510-2 may include a beamformer component 560 that may receive the RES output audio data 555 and perform beamforming to generate beamforming audio data 565. For example, the beamformer component 560 may generate directional audio data corresponding to N unique directions (e.g., N unique beams, such as Beam1-BeamN). The number of unique directions may vary without departing from the disclosure, and may be similar or different from the number of microphones 112. The Beamformer component 560 may include a fixed Beamformer (FBF) component, an adaptive Beamformer (ABF) component, and/or additional components without departing from the disclosure.

As illustrated in FIG. 5B, a beam merging component 570 may receive the beamformed audio data 565 and generate output audio data 575. In some examples, the beam merging component 570 may select portions of the beamformed audio data 565 (e.g., directional audio data) corresponding to two or more directions and generate the output audio data 575 using a weighted sum that combines these portions of the beamformed audio data 565. The disclosure is not limited thereto, however, and in other examples the beam merging component 570 may select a single portion of the beamformed audio data 565 associated with a single direction and generate the output audio data 575 using the selected portion of the beamformed audio data 565 without departing from the disclosure.

While FIG. 5B illustrates an example of the second audio processing components 510-2 including the Beamformer component 560 and the beam merging component 570, the disclosure is not limited thereto. In some examples, the Beamformer component 560 may correspond to a Fixed Beamformer (FBF) component configured to generate directional audio data in a plurality of directions, while the beam merging component 570 may correspond to an Adaptive Beamformer (ABF) component configured to perform adaptive beamforming and generate the output audio data 575 as a single output. Thus, while the output audio data 575 may correspond to multiple directions of the plurality of directions, the output audio data 575 may only include a single channel.

While FIG. 5B illustrates the second audio processing components 510-2 processing each of the microphone channels independently, the disclosure is not limited thereto. In some examples, the second audio processing components 510-2 may process only a portion of the microphone channels (e.g., the AEC output audio data 525 only corresponds 1-3 channels) and/or combine the multiple microphone channels into a single output (e.g., the AEC output audio data 525 corresponds to a single channel) without departing from the disclosure.

While FIG. 5B illustrates the second audio processing components 510-2 performing beamforming after performing echo cancellation (e.g., the Beamformer component 560 is located after the MCAEC component 520 in the audio pipeline 540, such that the beamformer component 560 processes an output of the MCAEC component 520), the disclosure is not limited thereto. In some examples, the second audio processing components 510-2 may perform beamforming prior to performing echo cancellation. For example, the beamformer component 560 may process the microphone audio data 505 to generate beamformed audio data that is then input to the MCAEC component 520. In some examples, the MCAEC component 520 may select a portion of the beamformed audio data as a target signal and a second portion of the beamformed audio data as a reference signal and perform echo cancellation by subtracting the reference signal from the target signal to generate a single output signal. However, the disclosure is not limited thereto and the MCAEC component 520 may perform echo cancellation individually for directional data associated with each direction without departing from the disclosure. For example, the MCAEC component 520 may generate up to N separate output signals without departing from the disclosure.

As described above with regard to FIG. 1, during a communication session the first device 110*a* may be acoustically coupled 30 to the second device 110*b*. For example, if the first device 110*a* and the second device 110*b* are located in proximity to one another within the environment 20, the first device 110*a* may recapture a portion of audio 35 output by the second device 110*b* and the second device 110*b* may recapture a portion of audio output by the first device 110*a*. This acoustic coupling 30 may create a positive feedback loop that causes output audio to grow uncontrollably loud (e.g., howling effect), negatively affecting a user experience until the devices 110*a*/110*b* are manually muted.

Figure 6A:
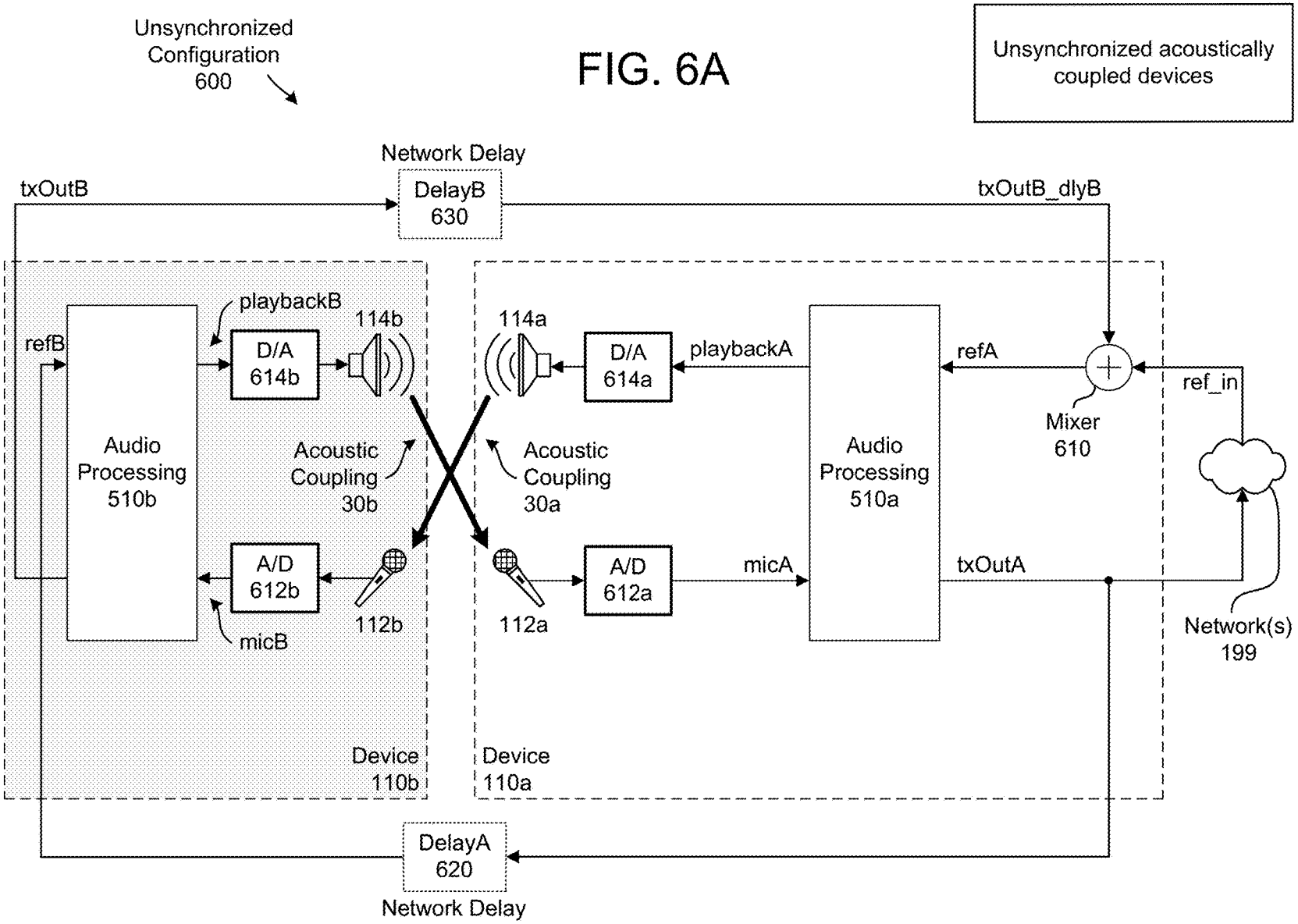
FIG. 6A is an example component diagram illustrating an unsynchronized configuration.

FIG. 6A is an example component diagram illustrating an unsynchronized configuration 600 between the first device 110*a* and the second device 110*b*. In the unsynchronized configuration 600 (e.g., unsynchronized acoustically coupled devices), the first device 110*a* performs audio processing independently from the second device 110*b*. Thus, while the first device 110*a* may perform first echo cancellation to remove a first echo signal generated by the first device 110*a*, the first echo cancellation does not remove a second echo signal generated by the second device 110*b*. Similarly, while the second device 110*b* may perform second echo cancellation to remove the second echo signal, the second echo cancellation does not remove the first echo signal.

During a communication session that includes the first device 110*a* and the second device 110*b*, the first device 110*a* may receive input audio data from the second device 110*b* and/or remote device(s) via network(s) 199. For example, the first device 110*a* may receive first input audio data (e.g., delayed second modified audio data (txOutB_dlyB)) originating from the second device 110*b* along with second input audio data (e.g., input reference audio data (ref_in)) originating from remote device(s). The second input audio data may represent speech from additional users participating in the communication session (e.g., remote participants in the communication session), audible sounds unrelated to the communication session (e.g., music, notifications, etc.), and/or the like without departing from the disclosure.

As illustrated in FIG. 6A, a mixer component 610 of the first device 110*a* may combine the first input audio data (e.g., delayed second modified audio data (txOutB_dlyB)) originating from the second device 110*b* and the second input audio data (e.g., input reference audio data (ref_in)) originating from remote device(s) to generate first reference audio data (refA). The mixer component 610 may output the first reference audio data to first audio processing components 510*a* of the first device 110*a*.

The first audio processing components 510*a* may perform signal processing on the first reference audio data (refA) to generate first playback audio data (playbackA). For example, the first audio processing components 510*a* may perform equalization processing (e.g., apply different gain values to different frequency bands of the first reference audio data), multi-band compression/limiting (e.g., compensate for distortion that is unique to the first loudspeaker 114*a*), and/or the like to generate the first playback audio data. The equalization processing may include first equalization processing associated with the first loudspeaker 114*a*, second equalization processing associated with user preferences, and/or the like, although the disclosure is not limited thereto.

Using the first loudspeaker 114*a* and the first playback audio data (playbackA), the first device 110*a* may generate first output audio. For example, the first device 110*a* may send the first playback audio data (playbackA) to a first digital-to-analog converter (D/A) component 614*a* (e.g., DAC) associated with the first loudspeaker 114*a*. The first D/A component 614*a* is configured to convert the first playback audio data from a digital signal to an analog signal and output the analog signal to the first loudspeaker 114*a* to generate the first output audio (e.g., first audible sound). While not illustrated in FIG. 6A, the first loudspeaker 114*a* and/or the first device 110*a* may include an amplifier to amplify the analog signal prior to generating the first output audio.

While generating the first output audio, the first device 110*a* may capture first input audio as first microphone audio data using a first microphone 112*a*. For example, the first microphone 112*a* may generate an analog signal representing the first input audio and may send the analog signal to a first analog-to-digital converter (A/D) component 612*a* (e.g., ADC) associated with the first microphone 112*a*. The first A/D component 612*a* is configured to convert the analog signal to a digital signal and generate first microphone audio data (micA), which the first A/D component 612*a* may output to the first audio processing components 510*a*. The first microphone audio data may include a representation of speech from a user (e.g., near end speech s(t)), a representation of the first output audio generated by the first loudspeaker 114*a* (e.g., first echo signal $y_1(t)$), a representation of the second output audio generated by the second loudspeaker 114*b* (e.g., second echo signal $y_2(t)$), a representation of ambient noise (e.g., noise n(t)), and/or representations of other audible noises present in the environment 20.

As illustrated in FIG. 6A, the first audio processing components 510*a* are configured to perform audio processing as described above with regard to FIGS. 5A-5B to generate first modified audio data (txOutA). For example, the first audio processing components 510*a* may perform first echo cancellation to remove the first echo signal $y_1(t)$ (e.g., portion of the first output audio recaptured by the first microphone 112*a*) from the first microphone audio data. However, as the first audio processing components 510*a* cannot determine the first echo signal $y_1(t)$ itself, the first audio processing components 510*a* instead generate a first echo estimate signal $y_1'(t)$ that corresponds to the first echo signal $y_1(t)$. Thus, when the first audio processing components 510*a* remove the first echo estimate signal $y_1'(t)$ from the first microphone audio data (micA), the first audio processing components 510*a* are removing at least a portion of the first echo signal $y_1(t)$. The first audio processing components 510*a* may generate the first echo estimate signal $y_1'(t)$ based on the first playback audio data (playbackA). For example, the first audio processing components 510*a* may apply transfer function(s) to the first playback audio data to generate the first echo estimate signal $y_1'(t)$.

As part of the communication session, the first device 110*a* may send the first modified audio data (txOutA) generated by the first audio processing components 510*a* to the second device 110*b* and/or the remote device(s) via the network(s) 199. As illustrated in FIG. 6A, the second device 110*b* may receive the first modified audio data (txOutA) after a first network delay 620 (e.g., DelayA), such that the second reference data (refB) corresponds to a delayed version of the first modified audio data (txOutA). While FIG. 6A illustrates the first device 110*a* sending the first modified audio data directly to the second device 110*b*, the disclosure is not limited thereto and in some examples the first device 110*a* may send the first modified audio data to a remote device via the network(s) 199 and the remote device may send the first modified audio data to the second device 110*b* via the network(s) 199. Thus, the first network delay 620 may correspond to a direct communication path and/or an indirect communication path between the first device 110*a* and the second device 110*b* without departing from the disclosure.

The second device 110*b* may include second audio processing components 510*b* configured to perform signal processing as described above with regard to the first audio processing components 510*a*. Thus, the second audio processing components 510*b* may perform signal processing on the second reference audio data (refB) to generate second playback audio data (playbackB). For example, the second audio processing components 510*b* may perform equalization processing (e.g., apply different gain values to different frequency bands of the second reference audio data), multiband compression/limiting (e.g., compensate for distortion that is unique to the second loudspeaker 114*b*), and/or the like to generate the second playback audio data. The equalization processing may include first equalization processing associated with the second loudspeaker 114*b*, second equalization processing associated with user preferences, and/or the like, although the disclosure is not limited thereto.

Using the second loudspeaker 114*b* and the second playback audio data (playbackB), the second device 110*b* may generate second output audio. For example, the second device 110*b* may send the second playback audio data (playbackB) to a second digital-to-analog converter (D/A) component 614*b* (e.g., DAC) associated with the second loudspeaker 114*b*. The second D/A component 614*b* is configured to convert the second playback audio data from a digital signal to an analog signal and output the analog signal to the second loudspeaker 114*b* to generate the second output audio (e.g., second audible sound). While not illustrated in FIG. 6A, the second loudspeaker 114*b* and/or the second device 110*b* may include an amplifier to amplify the analog signal prior to generating the second output audio.

While generating the second output audio, the second device 110*b* may capture second input audio as second microphone audio data using a second microphone 112*b*. For example, the second microphone 112*b* may generate an analog signal representing the second input audio and may send the analog signal to a second analog-to-digital converter (A/D) component 612*b* (e.g., ADC) associated with the second microphone 112*b*. The second A/D component 612*b* is configured to convert the analog signal to a digital signal and generate second microphone audio data (micB), which the second A/D component 612*b* may output to the second audio processing components 510*b*. The second microphone audio data may include a representation of speech from the user (e.g., near end speech s(t)), a representation of the first output audio generated by the first loudspeaker 114*a* (e.g., first echo signal $y_1(t)$), a representation of the second output audio generated by the second loudspeaker 114*b* (e.g., second echo signal $y_2(t)$), a representation of ambient noise (e.g., noise n(t)), and/or representations of other audible noises present in the environment 20.

As illustrated in FIG. 6A, the second audio processing components 510*b* are configured to perform audio processing as described above with regard to FIGS. 5A-5B to generate second modified audio data (txOutB). For example, the second audio processing components 510*b* may perform second echo cancellation to remove the second echo signal $y_2(t)$ (e.g., portion of the second output audio recaptured by the second microphone 112*b*) from the second microphone audio data. However, as the second audio processing components 510*b* cannot determine the second echo signal $y_2(t)$ itself, the second audio processing components 510*b* instead generate a second echo estimate signal $y_2'(t)$ that corresponds to the second echo signal $y_2(t)$. Thus, when the second audio processing components 510*b* remove the second echo estimate signal $y_2'(t)$ from the second microphone audio data (micB), the second audio processing components 510*b* are removing at least a portion of the second echo signal $y_2(t)$. The second audio processing components 510*b* may generate the second echo estimate signal $y_2'(t)$ based on the second playback audio data (playbackB). For example, the second audio processing components 510*b* may apply transfer function(s) to the second playback audio data to generate the second echo estimate signal $y_2'(t)$.

As part of the communication session, the second device 110*b* may send the second modified audio data (txOutB) generated by the second audio processing components 510*b* to the first device 110*a* and/or the remote device(s) via the network(s) 199 (not illustrated). As illustrated in FIG. 6A, the first device 110*a* may receive the second modified audio data (txOutB) after a second network delay 630 (e.g., DelayB), such that the first reference data (refA) corresponds to a delayed version of the second modified audio data (txOutB). While FIG. 6A illustrates the second device 110*b* sending the second modified audio data directly to the first device 110*a*, the disclosure is not limited thereto and in some examples the second device 110*b* may send the second modified audio data to a remote device via the network(s) 199 and the remote device may send the second modified audio data to the first device 110*a* via the network(s) 199. Thus, the second network delay 630 may correspond to a direct communication path and/or an indirect communication path between the second device 110*b* and the first device 110*a* without departing from the disclosure.

As illustrated in FIG. 6A, there may be first acoustic coupling 30*a* between the first loudspeaker 114*a* and the second microphone 112*b* and/or second acoustic coupling 30*b* between the second loudspeaker 114*b* and the first microphone 112*a*. For example, due to the first acoustic coupling 30*a* the second microphone 112*b* may recapture a portion of the first output audio generated by the first loudspeaker 114*a*, and due to the second acoustic coupling 30*b* the first microphone 112*a* may recapture a portion of the second output audio generated by the second loudspeaker 114*b*.

As the first device 110*a* is not synchronized with the second device 110*b*, the second audio processing components 510*b* do not have access to the first playback audio data (playbackA) and cannot remove the first echo signal $y_1(t)$ represented in the second microphone audio data (micB). Similarly, the first audio processing components 510*a* do not have access to the second playback audio data (playbackB) and cannot remove the second echo signal $y_2(t)$ represented in the first microphone audio data (micA).

Figure 6B:
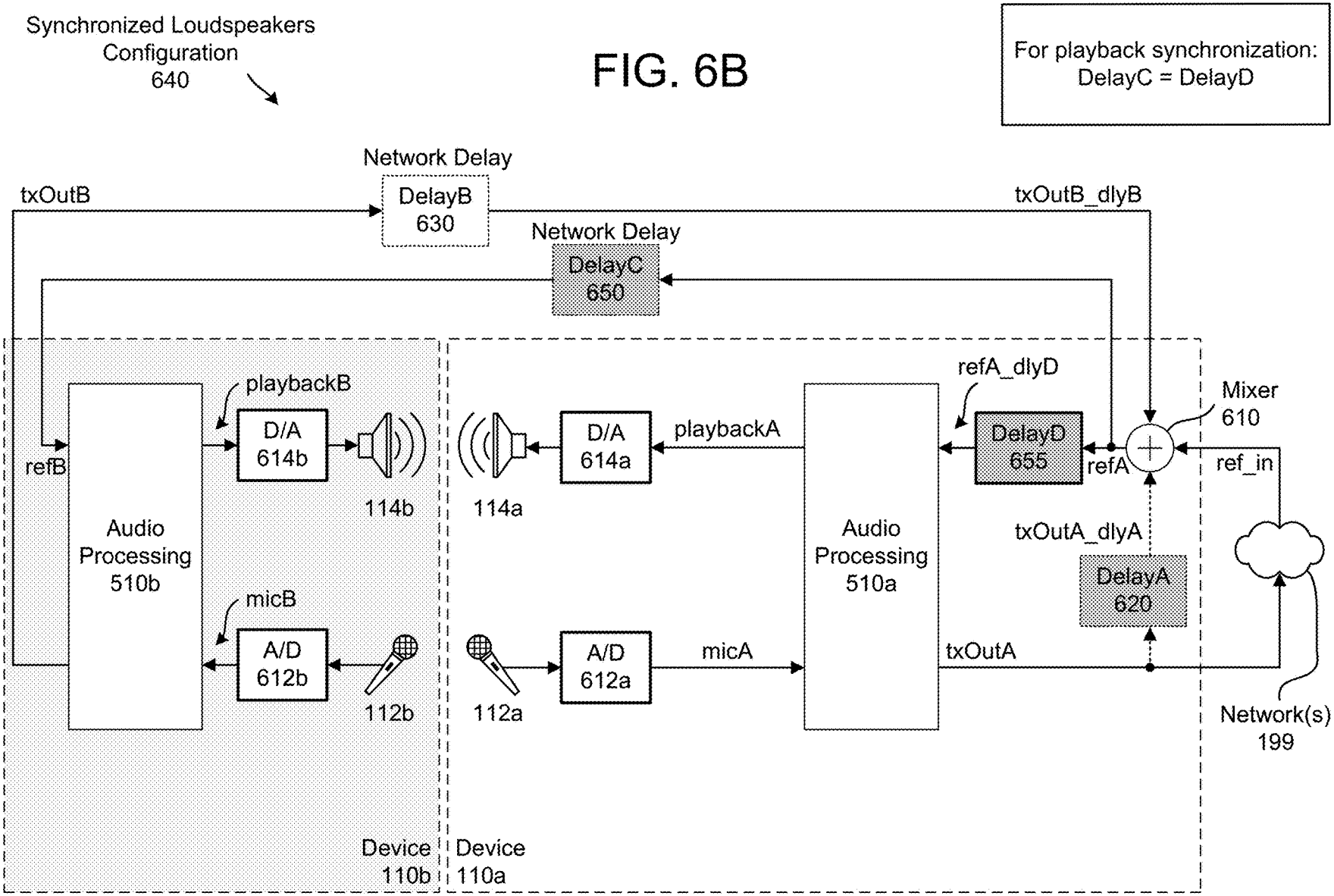
FIGS. 6B-6C are example component diagrams illustrating examples of centralized echo cancellation configurations with synchronized loudspeakers and/or microphones.

FIG. 6B is an example component diagram illustrating an example of a centralized echo cancellation configuration with synchronized loudspeakers (e.g., synchronized loudspeakers configuration 640). As illustrated in FIG. 6B, in the synchronized loudspeakers configuration 640 the first device 110*a* and the second device 110*b* synchronize output audio (e.g., synchronize playback), such that the first output audio generated by the first loudspeaker 114*a* is synchronized (e.g., time-aligned) with the second output audio generated by the second loudspeaker 114*b*. Thus, a user experience is improved as the first output audio and the second output audio are perceived by a user without noticeable delays.

In order to synchronize the playback, the first device 110*a* acts as a hub device, such that any audio data intended for the second device 110*b* is routed through the first device

110*a*. In some examples, the first device 110*a* and the second device 110*b* may generate the first output audio and the second output audio based on the same playback audio data. For example, FIG. 6B illustrates an example in which the first device 110*a* generates the first reference audio data (refA) and both the first device 110*a* and the second device 110*b* generate output audio based on the first reference audio data. However, the disclosure is not limited thereto, and in other examples the first device 110*a* may generate the first output audio based on first playback audio data and the second device 110*b* may generate the second output audio based on second playback audio data that is different from the first playback audio data without departing from the disclosure. For example, the first playback audio data may not include a representation of the first modified audio data and the second playback audio data may not include a representation of the second modified audio data, although the disclosure is not limited thereto.

As illustrated in FIG. 6B, the first device 110*a* may generate the first reference audio data (refA) as described above with regard to FIG. 6A. For example, the mixer component 610 may combine the first input audio data (e.g., delayed second modified audio data (txOutB_dlyB)) originating from the second device 110*b* and the second input audio data (e.g., input reference audio data (ref_in)) originating from remote device(s) to generate the first reference audio data (refA).

In this example, however, instead of sending the first modified audio data (txOutA) directly to the second device 110*b*, as illustrated in FIG. 6A, the first device 110*a* may send the first modified audio data (txOutA) to remote device(s) via the network(s) 199, such that the second input audio data includes the first modified audio data (txOutA). This is illustrated in FIG. 6B by a dashed line between the first modified audio data (txOutA) and the mixer component 610, resulting in the mixer component 610 receiving delayed first modified audio data (txOutA_dlyA). A length of the delay corresponds to the first network delay 620 (e.g., DelayA) described above. In some examples, however, the first device 110*a* may not send the first modified audio data (txOutA) to the remote device(s) and may instead send the first modified audio data (txOutA) to the mixer component 610 (e.g., either directly or after performing a delay) without departing from the disclosure.

As illustrated in FIG. 6B, the first device 110*a* may send the first reference audio data (refA) to the second device 110*b*. The second device 110*b* may receive the first reference audio data (refA) after a third network delay 650 (e.g., DelayC), such that the second reference data (refB) corresponds to a delayed version of the first reference audio data (refA). In order to synchronize playback between the first output audio and the second output audio, the first device 110*a* may include a first delay (DelayD) component 655 configured to generate delayed first reference audio data (refA_dlyD). For example, the first device 110*a* may determine a first time delay associated with the third network delay 650 (e.g., DelayC) and delay the first reference audio data by the first time delay (e.g., DelayC=DelayD). Thus, the first audio processing components 510*a* generate the first playback audio data (playbackA) using the delayed first reference audio data (refA_dlyD), such that the first output audio is synchronized with the second output audio.

Figure 6C:
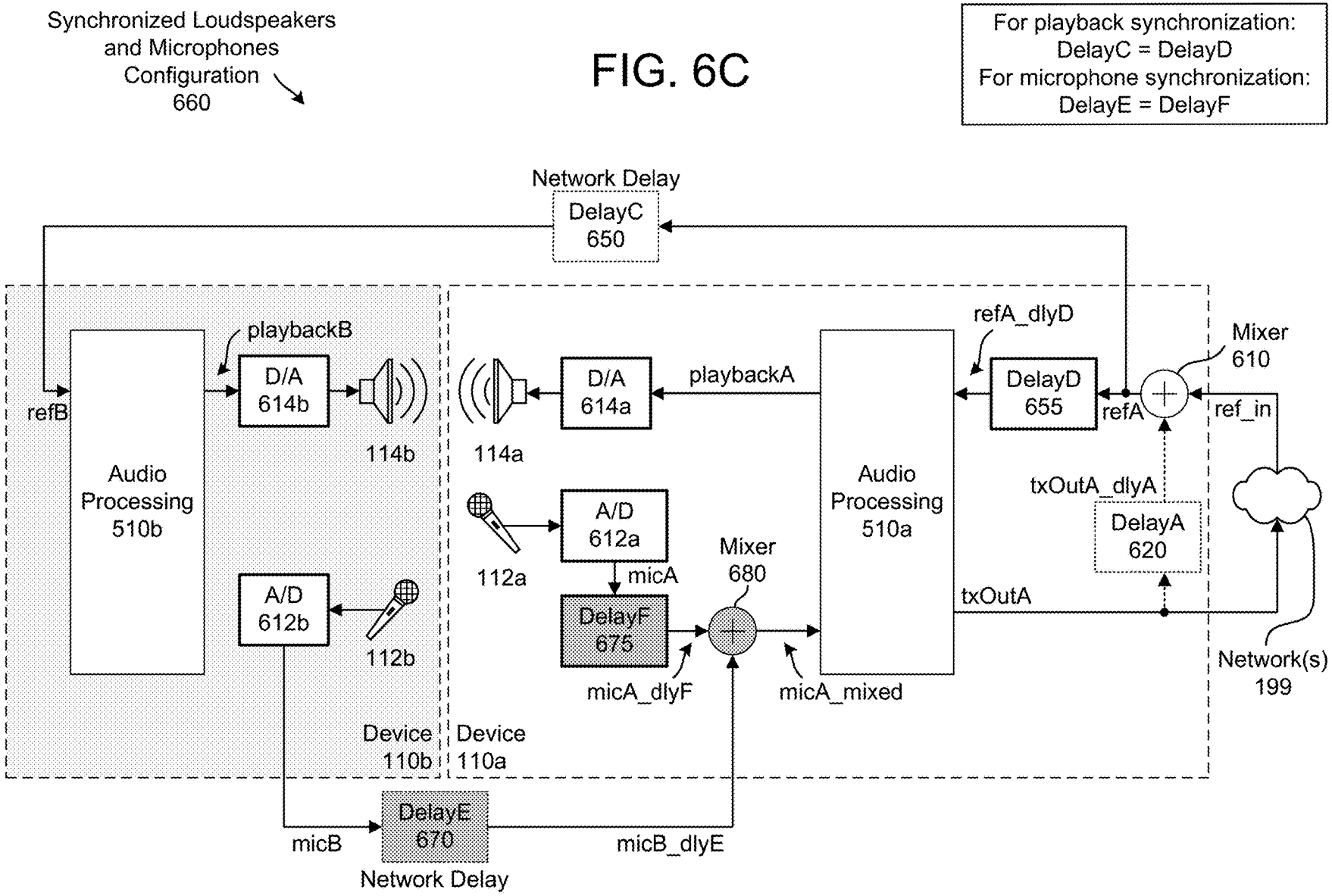

FIG. 6C is an example component diagram illustrating an example of a centralized echo cancellation configuration with synchronized loudspeakers and synchronized microphones (e.g., synchronized loudspeakers and microphones configuration 660). In addition to synchronizing playback, as described above with regard to FIG. 6B, the first device 110*a* may be configured to receive the second microphone audio data (micB) and synchronize the first microphone audio data (micA) with the second microphone audio data (micB). As a result, the second audio processing components 510*b* do not receive the second microphone audio data (micB) or generate the second modified audio data (txOutB).

As illustrated in FIG. 6C, the second device 110*b* may send the second microphone audio data (micB) to the first device 110*a* and the first device 110*a* may receive the second microphone audio data (micB) after a fourth network delay 670 (e.g., DelayE), such that the first device 110*a* receives delayed second microphone audio data (micB_dlyE) that corresponds to a delayed version of the second microphone audio data (micB). In order to synchronize the microphone signals (e.g., synchronize the first input audio and the second input audio), the first device 110*a* may include a second delay (DelayF) component 675 configured to generate delayed first microphone audio data (mica_dlyF). For example, the first device 110*a* may determine a second time delay associated with the fourth network delay 670 (e.g., DelayE) and delay the first microphone audio data by the second time delay (e.g., DelayE=DelayF).

The first device 110*a* may include a mixer component 680 configured to combine the delayed first microphone audio data (mica_dlyF) and the delayed second microphone audio data (micB_dlyE) to generate mixed microphone audio data (micA_mixed). Thus, instead of using the first microphone audio data (micA), the first audio processing components 510*a* may generate the first modified audio data (txOutA) using the mixed microphone audio data (micA_mixed).

Figure 7:
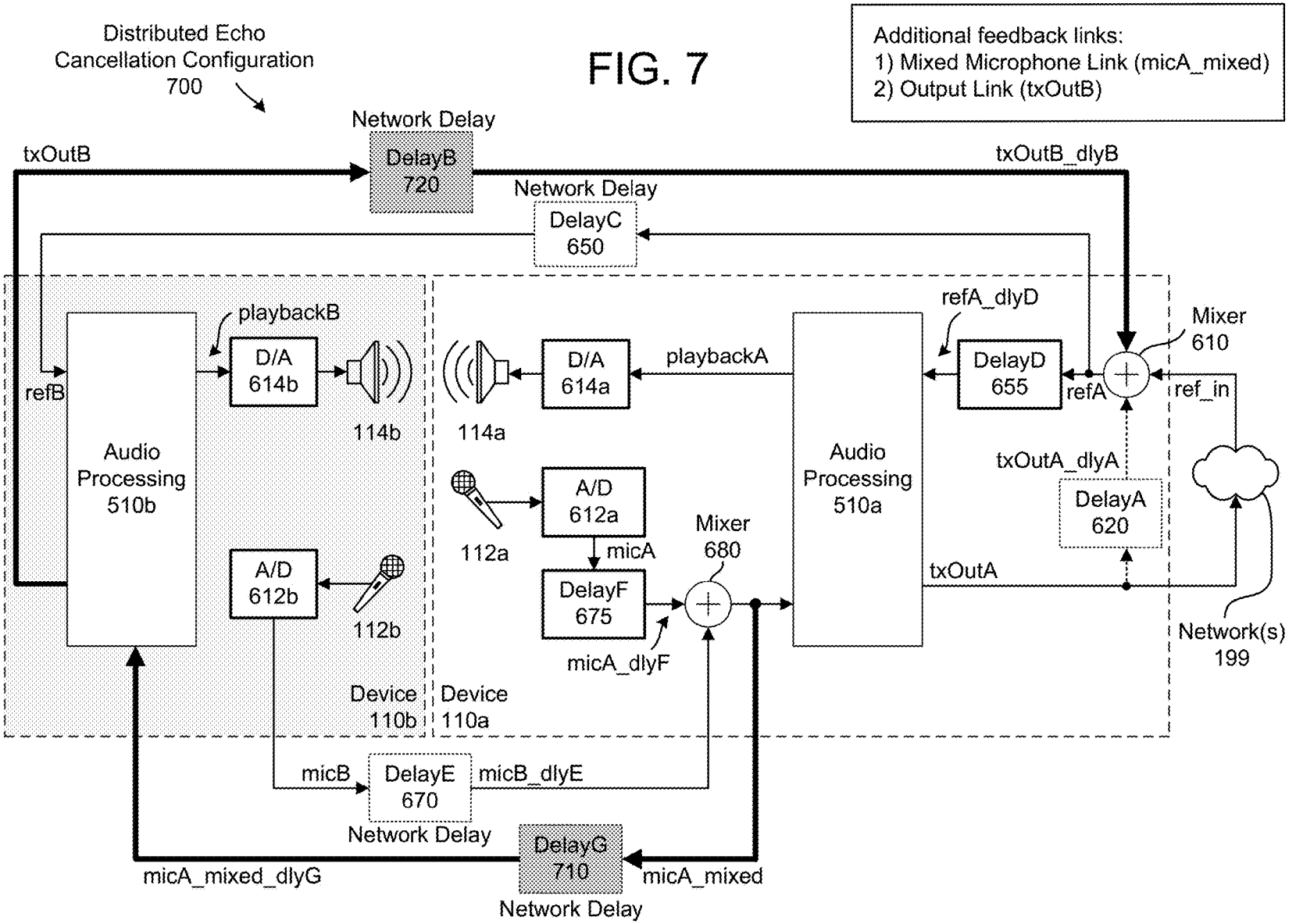
FIG. 7 illustrates an example component diagram for performing distributed echo cancellation according to embodiments of the present disclosure.

FIG. 7 illustrates an example component diagram for performing distributed echo cancellation according to embodiments of the present disclosure. As illustrated in FIG. 7, a distributed echo cancellation configuration 700 builds off of the synchronized loudspeakers and microphones configuration 660 illustrated in FIG. 6C by adding additional feedback links between the first device 110*a* and the second device 110*b*. As many of the components illustrated in FIG. 7 were described in detail above with regard to FIG. 6C, a redundant description is omitted.

As illustrated in FIG. 7, the distributed echo cancellation configuration 700 may enable the second device 110*b* to perform second echo cancellation and generate the second modified audio data (txOutB). For example, the distributed echo cancellation configuration 700 may include a first feedback link (e.g., mixed microphone link) that sends the mixed microphone audio data (micA_mixed) from the first device 110*a* to the second device 110*b* and a second feedback link (e.g., output link) that sends the second modified audio data (txOutB) from the second device 110*b* to the first device 110*a*. While FIG. 7 illustrates the first device 110*a* only being synchronized with the second device 110*b*, the distributed echo cancellation configuration 700 may include bidirectional feedback links (e.g., mixed microphone link and output link) for each additional device 110 that is synchronized with the first device 110*a* without departing from the disclosure.

As illustrated in FIG. 7, the first feedback link corresponds to the first device 110*a* sending the mixed microphone audio data (micA_mixed) to the second device 110*b*. The second device 110*b* may receive the mixed microphone audio data (micA_mixed) after a fifth network delay 710 (e.g., DelayG), such that the second device 110*b* receives delayed mixed microphone audio data (micA_mixed_dlyG) that corresponds to a delayed version of the mixed microphone audio data (micA_mixed). In some examples, the first device 110*a* may send the mixed microphone audio data (micA_mixed) to the second device 110*b* via a wireless connection. For example, the first device 110*a* may estimate the fifth network delay 710 (e.g., DelayG) by calculating a transit time for individual data packets sent between the first device 110*a* and the second device 110*b* via the wireless connection (e.g., wireless link), although the disclosure is not limited thereto. While the fifth network delay 710 (e.g., DelayG) may correspond to the same wireless connection as the fourth network delay 670 (e.g., DelayE), the actual delay time may be different without departing from the disclosure.

As described in greater detail above, the second audio processing components 510*b* may perform second echo cancellation using the delayed mixed microphone audio data (micA_mixed_dlyG) and the second playback audio data (playbackB) to generate the second modified audio data (txOutB). Thus, the distributed echo cancellation configuration 700 removes a direct link between the second A/D component 612*b* associated with the second microphone 112*b* and the second audio processing components 510*b*. Instead, the distributed echo cancellation configuration 700 assures that the first microphone audio data (micA) and the second microphone audio data (micB) are synchronized and generates the mixed microphone audio data (micA_mixed) using the synchronized microphone signals.

After the second audio processing components 510*b* generate the second modified audio data (txOutB), the second feedback link corresponds to the second device 110*b* sending the second modified audio data (txOutB) to the first device 110*a*. The first device 110*a* may receive the second modified audio data (txOutB) after a sixth network delay 720 (e.g., DelayB), such that the first device 110*a* receives delayed second modified audio data (txOutB_dlyB) that corresponds to a delayed version of the second modified audio data (txOutB). In some examples, the second device 110*b* may send the second modified audio data (txOutB) to the first device 110*a* via a wireless connection. For example, the first device 110*a* may estimate the sixth network delay 720 (e.g., DelayB) by calculating a transit time for individual data packets sent between the first device 110*a* and the second device 110*b* via the wireless connection (e.g., wireless link), although the disclosure is not limited thereto. While the sixth network delay 720 (e.g., DelayB) may correspond to the same wireless connection as the third network delay 650 (e.g., DelayC), the actual delay time may be different without departing from the disclosure.

While FIG. 7 illustrates the first device 110*a* only being synchronized with the second device 110*b*, the distributed echo cancellation configuration 700 may include bidirectional feedback links (e.g., mixed microphone link and output link) for each additional device 110 that is synchronized with the first device 110*a* without departing from the disclosure.

Figure 8:
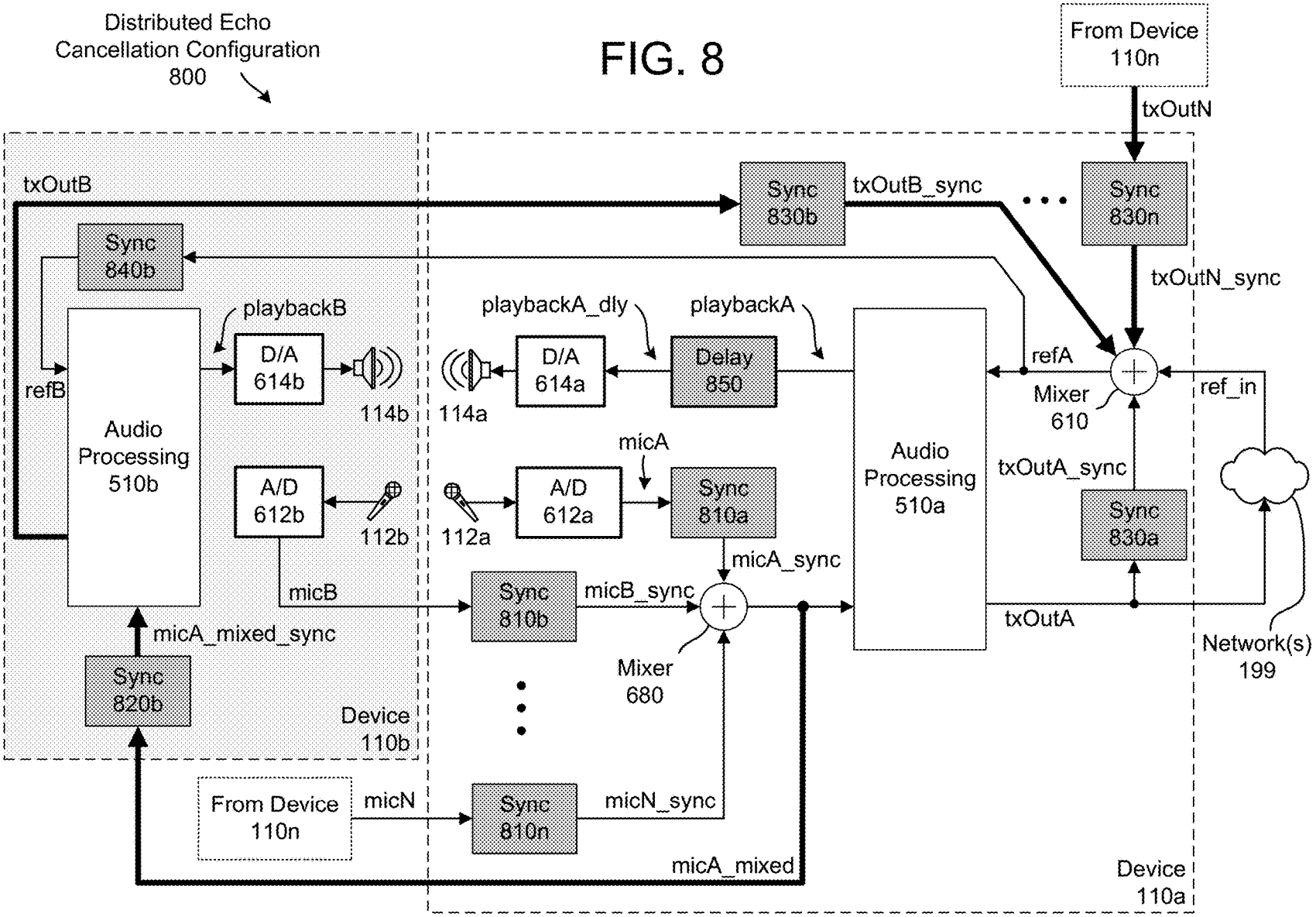
FIG. 8 illustrates an example component diagram for performing distributed echo cancellation according to embodiments of the present disclosure.

FIG. 8 illustrates an example component diagram for performing distributed echo cancellation according to embodiments of the present disclosure. As illustrated in FIG. 8, a distributed echo cancellation configuration 800 may include the same bidirectional feedback links (e.g., mixed microphone link and output link) and other components described above with regard to FIG. 7. Thus, the first device 110*a* may send the mixed microphone audio data (micA_mixed) to the second device 110*b* and/or other devices 110, and the second device 110*b* may send the second modified audio data (txOutB) to the first device 110*a*. However, instead of illustrating the network delays and corresponding delayed audio signals, FIG. 8 illustrates synchronization components configured to ensure synchronization between the first device 110*a* and one or more devices 110*b*-110*n*. Thus, the synchronization components may compensate for transit times associated with data packets being sent from the first device 110*a* to the second device 110*b* and/or from the second device 110*b* to the first device 110*a* via a wireless connection (e.g., wireless link).

In the distributed echo cancellation configuration 800 illustrated in FIG. 8, the first device 110*a* may include microphone synchronization components 810 configured to synchronize microphone signals generated by the first microphone 112*a* and/or received from the devices 110*b*-110*n*. For example, the first device 110*a* may include a first microphone synchronization component 810*a* configured to synchronize the first microphone audio data (micA) to generate first synchronized microphone audio data (micA_sync), a second microphone synchronization component 810*b* configured to synchronize the second microphone audio data (micB) to generate second synchronized microphone audio data (micB_sync), and so on until an n-th microphone synchronization component 810*n* configured to synchronize n-th microphone audio data (micN) to generate n-th synchronized microphone audio data (micN_sync). Thus, the mixer component 680 may generate the mixed microphone audio data (micA_mixed) using synchronized microphone signals.

In addition, each of the devices 110*b*-110*n* may include a target synchronization component 820 configured to synchronize the mixed microphone audio data (micA_mixed) between devices 110. For example, the second device 110*b* may include a second target synchronization component 820*b* configured to adjust a delay of the mixed microphone audio data (micA_mixed) based on a network delay between the first device 110*a* and the second device 110*b*. Thus, the second target synchronization component 820*b* may generate synchronized mixed microphone audio data (micA_mixed sync) and the second audio processing components 510*b* may generate the second modified audio data (txOutB) using the synchronized mixed microphone audio data (micA_mixed sync).

The second feedback link (e.g., output link) may include similar synchronization components. As illustrated in FIG. 8, the first device 110*a* may include modified synchronization components 830 configured to synchronize modified audio signals generated by the first audio processing components 810*a* and/or received from the devices 110*b*-110*n*. For example, the first device 110*a* may include a first modified synchronization component 830*a* configured to synchronize the first modified audio data (txOutA) to generate first synchronized modified audio data (txOutA_sync), a second modified synchronization component 830*b* configured to synchronize the second modified audio data (txOutB) to generate second synchronized modified audio data (txOutB sync), and so on until an n-th modified synchronization component 830*n* configured to synchronize n-th modified audio data (txOutN) to generate n-th synchronized modified audio data (txOutN_sync). Thus, the mixer component 610 may generate the first reference audio data (refA) using synchronized modified audio signals.

In addition, each of the devices 110*b*-110*n* may include a reference synchronization component 840 configured to synchronize the reference audio signals between devices 110. For example, the second device 110*b* may include a second reference synchronization component 840*b* configured to adjust a delay of the first reference audio data (refA) based on a network delay between the first device 110*a* and the second device 110*b*. Thus, the second reference synchronization component 840*b* may generate the second reference audio data (refB) and generate the second modified audio data (txOutB) using the second reference audio data (refB).

Figure 9:
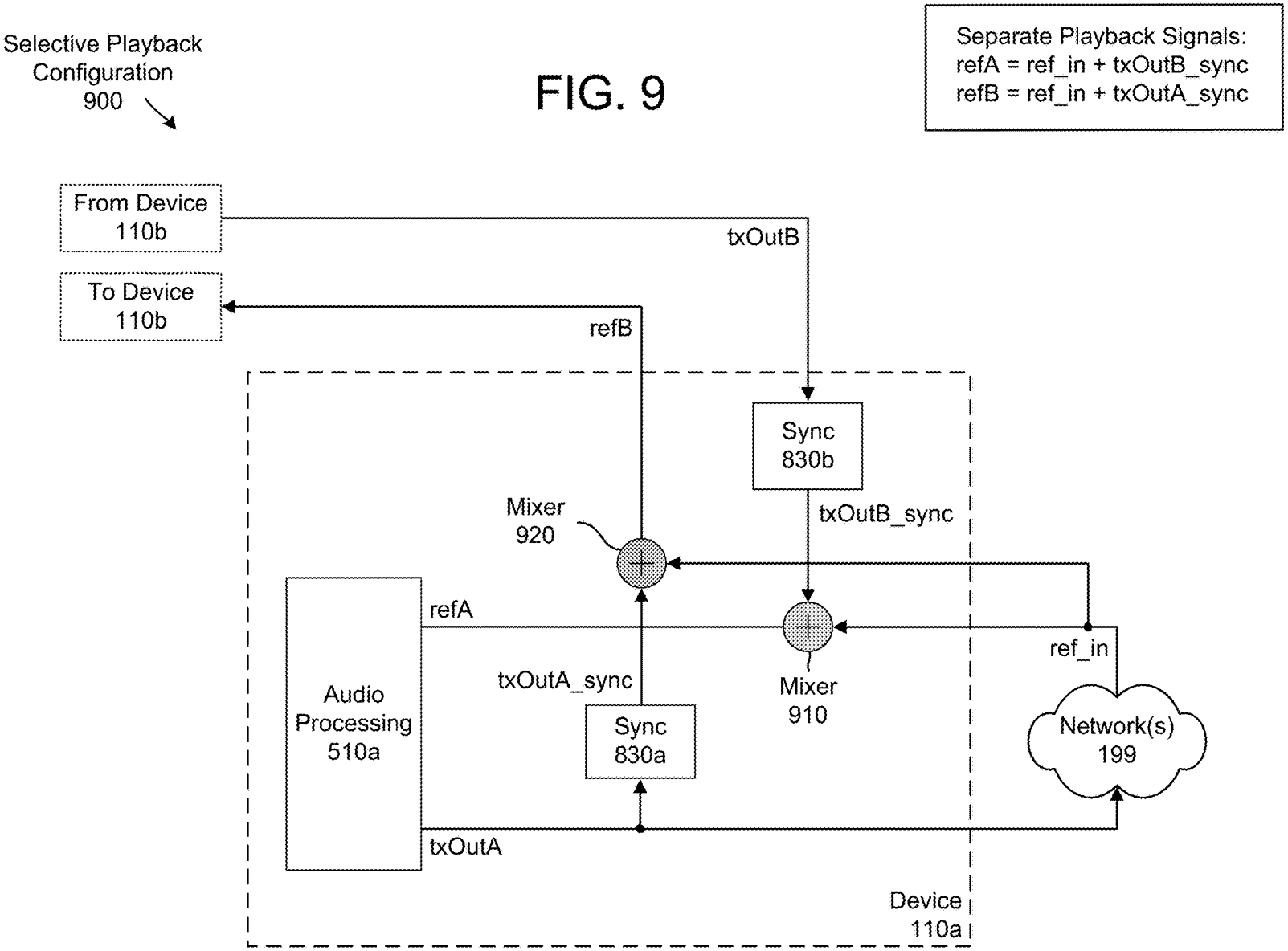
FIG. 9 illustrates an example component diagram for generating selective playback according to embodiments of the present disclosure.

FIG. 9 illustrates an example component diagram for generating selective playback according to embodiments of the present disclosure. As illustrated in the selective playback configuration 900, the first device 110*a* may generate individual playback audio signals for each of the devices 110 synchronized with the first device 110*a*. For example, the first device 110*a* may include a first mixer component 910 configured to generate the first reference audio data (refA) for the first device 110*a* using first input audio data (e.g., input reference audio data (ref_in)) originating from remote device(s) and second input audio data (e.g., second synchronized modified audio data (txOutB sync)) associated with the second device 110*b*. In addition, the first device 110*a* may include a second mixer component 920 configured to generate the second reference audio data (refB) for the second device 110*b* using the first input audio data (e.g., input reference audio data (ref_in)) originating from remote device(s) and third input audio data (e.g., first synchronized modified audio data (txOutA_sync)) associated with the first device 110*a*. While not illustrated in FIG. 9, the first device 110*a* may include additional mixer components for any additional devices 110 that are synchronized with the first device 110*a*.

The first input audio data may correspond to audible sounds associated with the communication session that are common to the first reference audio data (refA) and the second reference audio data (refB). For example, the first input audio data may represent speech from additional users participating in the communication session (e.g., remote participants in the communication session), audible sounds unrelated to the communication session (e.g., music, notifications, etc.), and/or the like without departing from the disclosure.

Figure 10:
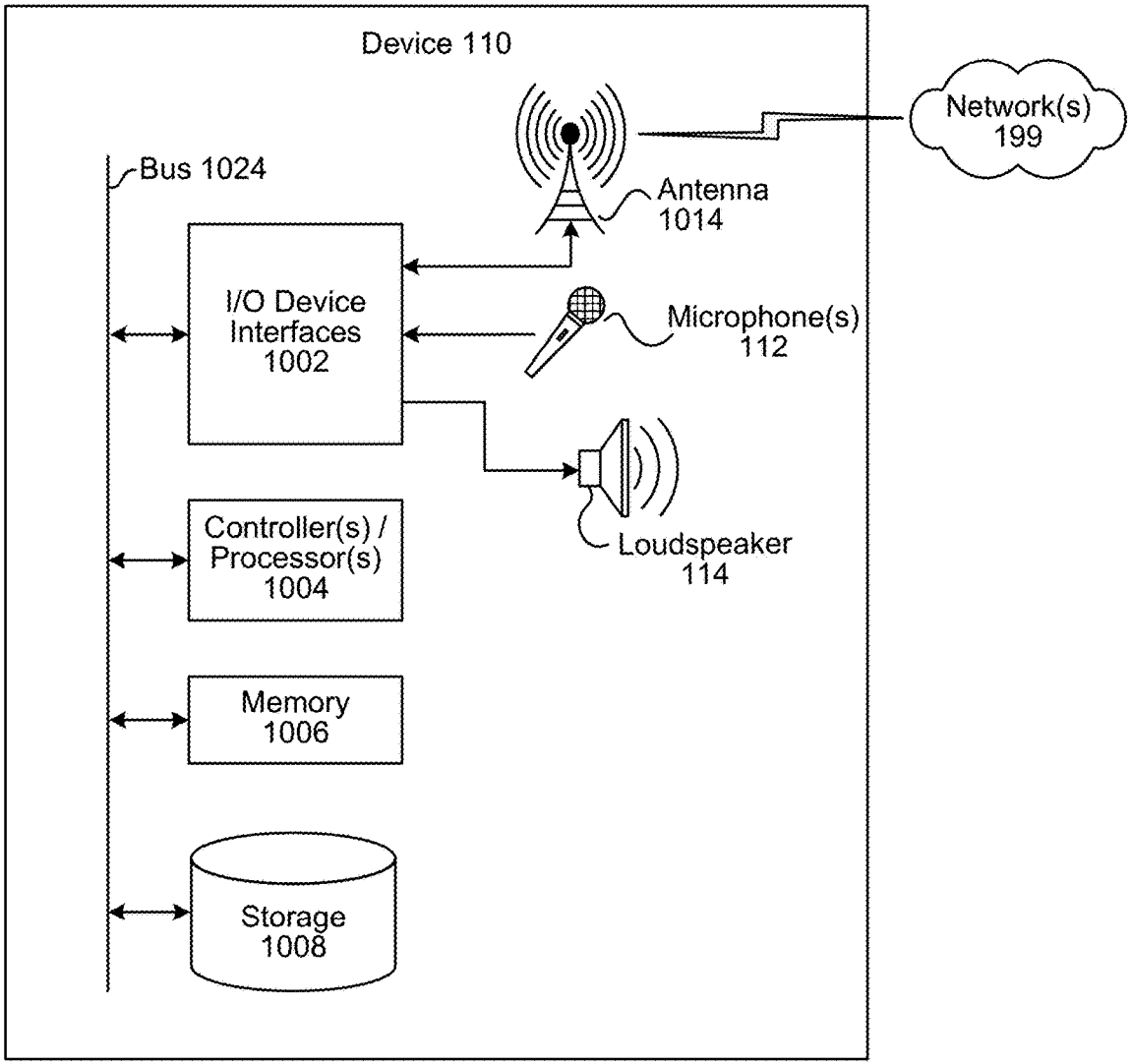
FIG. 10 is a block diagram conceptually illustrating example components of a device, according to embodiments of the present disclosure.
Figure 11:
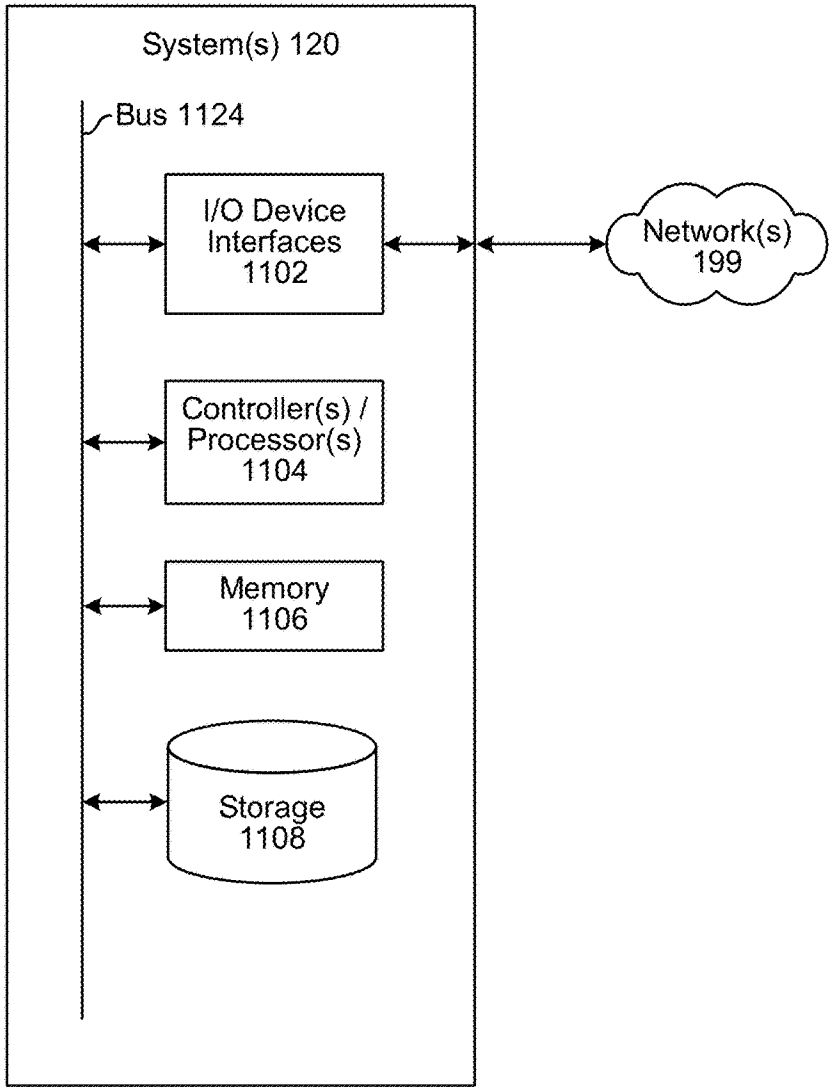
FIG. 11 is a block diagram conceptually illustrating example components of a system, according to embodiments of the present disclosure.

FIG. 10 is a block diagram conceptually illustrating a device 110. FIG. 11 is a block diagram conceptually illustrating example components of a remote device, such as the media transport system 120. In operation, the system 100 may include computer-readable and computer-executable instructions that reside on the device 110 and/or the media transport system 120, as will be discussed further below. In addition, multiple devices 110 and/or multiple media transport systems 120 may be included in the system 100 of the present disclosure without departing from the disclosure.

The media transport system 120 may include one or more servers. A "server" as used herein may refer to a traditional server as understood in a server/client computing structure but may also refer to a number of different computing components that may assist with the operations discussed herein. For example, a server may include one or more physical computing components (such as a rack server) that are connected to other devices/components either physically and/or over a network and is capable of performing computing operations. A server may also include one or more virtual machines that emulates a computer system and is run on one or across multiple devices. A server may also include other combinations of hardware, software, firmware, or the like to perform operations discussed herein. The media transport system 120 may be configured to operate using one or more of a client-server model, a computer bureau model, grid computing techniques, fog computing techniques, mainframe techniques, utility computing techniques, a peer-to-peer model, sandbox techniques, or other computing techniques.

Each of these devices (110/120) may include one or more controllers/processors (1004/1104), which may each include a central processing unit (CPU) for processing data and computer-readable instructions, and a memory (1006/1106) for storing data and instructions of the respective device. The memories (1006/1106) may individually include volatile random access memory (RAM), non-volatile read only memory (ROM), non-volatile magnetoresistive memory (MRAM), and/or other types of memory. Each device (110/120) may also include a data storage component (1008/1108) for storing data and controller/processor-executable instructions. Each data storage component (1008/1108) may individually include one or more non-volatile storage types such as magnetic storage, optical storage, solid-state storage, etc. Each device (110/120) may also be connected to removable or external non-volatile memory and/or storage (such as a removable memory card, memory key drive, networked storage, etc.) through respective input/output device interfaces (1002/1102).

Each device (110/120) may include components that may comprise processor-executable instructions stored in storage (1008/1108) to be executed by controller(s)/processor(s) (1004/1104) (e.g., software, firmware, hardware, or some combination thereof). For example, components of the device (110/120) may be part of a software application running in the foreground and/or background on the device (110/120). Some or all of the controllers/components of the device (110/120) may be executable instructions that may be embedded in hardware or firmware in addition to, or instead of, software. In one embodiment, the device (110/120) may operate using an Android operating system (such as Android 4.3 Jelly Bean, Android 4.4 KitKat or the like), an Amazon operating system (such as FireOS or the like), or any other suitable operating system.

Computer instructions for operating each device (110/120) and its various components may be executed by the respective device's controller(s)/processor(s) (1004/1104), using the memory (1006/1106) as temporary "working" storage at runtime. A device's computer instructions may be stored in a non-transitory manner in non-volatile memory (1006/1106), storage (1008/1108), or an external device(s). Alternatively, some or all of the executable instructions may be embedded in hardware or firmware on the respective device in addition to or instead of software.

Each device (110/120) includes input/output device interfaces (1002/1102). A variety of components may be connected through the input/output device interfaces (1002/1102), as will be discussed further below. Additionally, each device (110/120) may include an address/data bus (1024/1124) for conveying data among components of the respective device. Each component within a device (110/120) may also be directly connected to other components in addition to (or instead of) being connected to other components across the bus (1024/1124).

Referring to FIG. 10, the device 110 may include input/output device interfaces 1002 that connect to a variety of components such as an audio output component such as a loudspeaker 114, a wired headset or a wireless headset (not illustrated), or other component capable of outputting audio (e.g., producing sound). The audio output component may be integrated into a single device or may be separate. The device 110 may also include one or more audio capture component(s). For example, the device 110 may include one or more microphone(s) (e.g., a plurality of microphone(s) in a microphone array), a wired headset or a wireless headset (not illustrated), and/or the like. The audio capture component(s) may be integrated into a single device or may be separate. If an array of microphones is included, approximate distance to a sound's point of origin may be determined by acoustic localization based on time and amplitude differences between sounds captured by different microphones of the array. The device 110 may additionally include a display (not illustrated) for displaying content and/or may further include a camera (not illustrated), although the disclosure is not limited thereto. In some examples, the microphone(s) 112 and/or loudspeaker(s) 114 may be external to the device 110, although the disclosure is not limited thereto. The input/output interfaces 1002 may include A/D converters (not illustrated) and/or D/A converters (not illustrated) without departing from the disclosure.

The input/output device interfaces 1002 may also include an interface for an external peripheral device connection such as universal serial bus (USB), FireWire, Thunderbolt, Ethernet port or other connection protocol that may connect to network(s) 199.

The input/output device interfaces 1002/1102 may be configured to operate with network(s) 199. For example, via antenna(s) 1014, the input/output device interfaces 1002 may connect to one or more networks 199 via a wireless local area network (WLAN) (such as Wi-Fi) radio, Bluetooth, and/or wireless network radio, such as a radio capable of communication with a wireless communication network such as a Long Term Evolution (LTE) network, WiMAX network, 3G network, 4G network, 5G network, etc. A wired connection such as Ethernet may also be supported. Thus, the devices (110/120) may be connected to the network(s) 199 through either wired or wireless connections.

The network(s) 199 may include a local or private network or may include a wide network (e.g., wide area network (WAN)), such as the internet. Through the network(s) 199, the system may be distributed across a networked environment. The I/O device interface (1002/1102) may also include communication components that allow data to be exchanged between devices such as different physical servers in a collection of servers or other components.

The components of the device 110 and/or the media transport system 120 may include their own dedicated processors, memory, and/or storage. Alternatively, one or more of the components of the device 110 and/or the media transport system 120 may utilize the I/O interfaces (1002/1102), processor(s) (1004/1104), memory (1006/1106), and/or storage (1008/1108) of the device(s) 110 and/or the media transport system 120.

As noted above, multiple devices may be employed in a single system. In such a multi-device system, each of the devices may include different components for performing different aspects of the system's processing. The multiple devices may include overlapping components. The components of the device 110 and the system 120 as described herein, are illustrative, and may be located as a stand-alone device or may be included, in whole or in part, as a component of a larger device or system.

Figure 12:
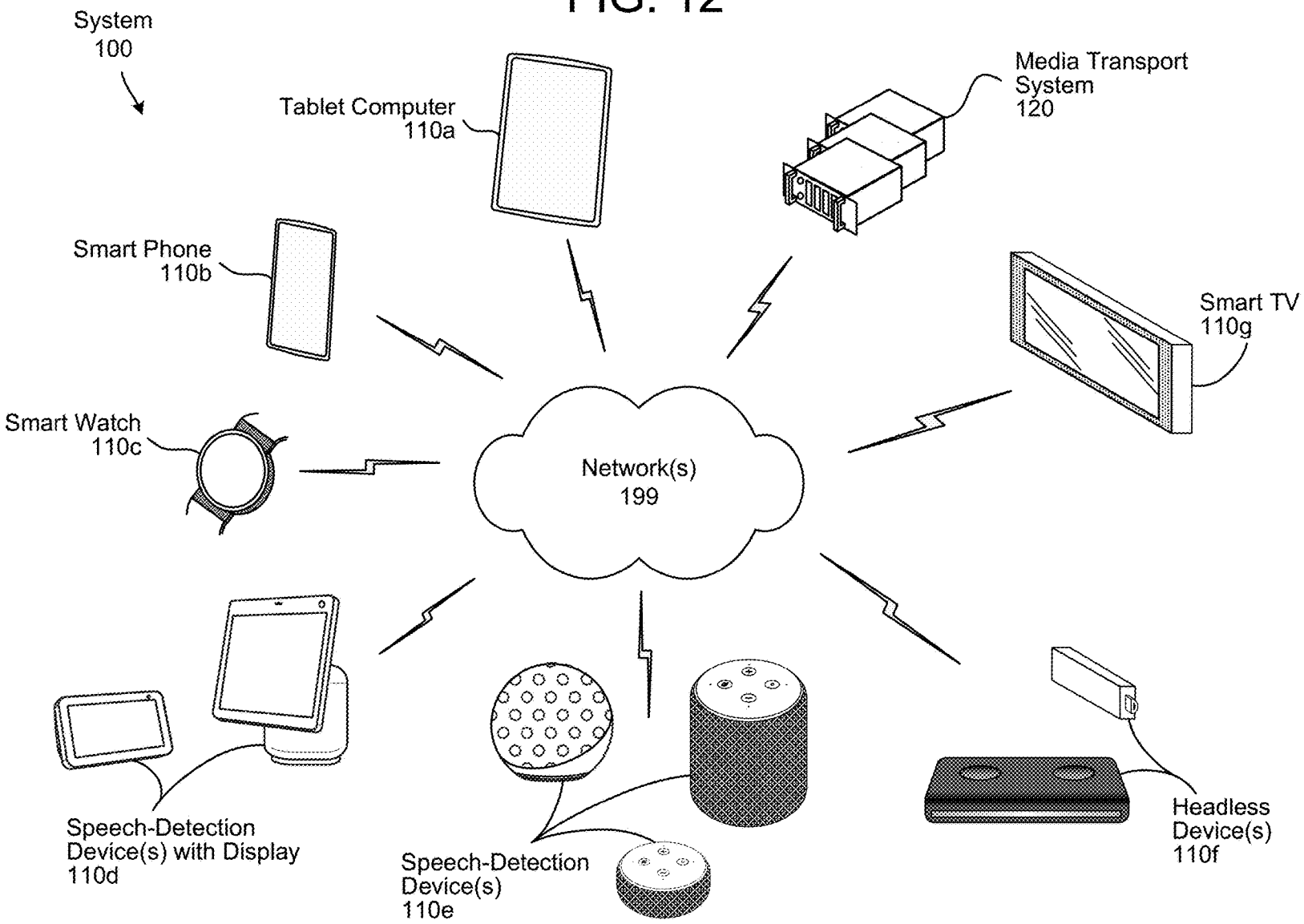
FIG. 12 illustrates an example of a computer network for use with the overall system, according to embodiments of the present disclosure.

As illustrated in FIG. 12, multiple devices (110*a*-110*g* and 120) may contain components of the system and the devices may be connected over a network(s) 199. The network(s) 199 may include a local or private network or may include a wide network such as the Internet. Devices may be connected to the network(s) 199 through either wired or wireless connections. For example, a tablet computer 110*a*, a smart phone 110*b*, a smart watch 110*c*, speech-detection device(s) with a display 110*d*, speech-detection device(s) 110*e*, headless device(s) 110*h*, and/or a smart television 110*g* may be connected to the network(s) 199 through a wired and/or wireless connection. For example, the devices 110 may be connected to the network(s) 199 via an Ethernet port, a wireless service provider, over a Wi-Fi or cellular network connection, and/or the like.

The concepts disclosed herein may be applied within a number of different devices and computer systems, including, for example, general-purpose computing systems, speech processing systems, server-client computing systems, mainframe computing systems, telephone computing systems, laptop computers, cellular phones, personal digital assistants (PDAs), tablet computers, video capturing devices, wearable computing devices (watches, glasses, etc.), other mobile devices, video game consoles, speech processing systems, distributed computing environments, etc. Thus the components, components and/or processes described above may be combined or rearranged without departing from the present disclosure. The functionality of any component described above may be allocated among multiple components, or combined with a different component. As discussed above, any or all of the components may be embodied in one or more general-purpose microprocessors, or in one or more special-purpose digital signal processors or other dedicated microprocessing hardware. One or more components may also be embodied in software implemented by a processing unit. Further, one or more of the components may be omitted from the processes entirely.

The above aspects of the present disclosure are meant to be illustrative. They were chosen to explain the principles and application of the disclosure and are not intended to be exhaustive or to limit the disclosure. Many modifications and variations of the disclosed aspects may be apparent to those of skill in the art. Persons having ordinary skill in the field of computers and speech processing should recognize that components and process steps described herein may be interchangeable with other components or steps, or combinations of components or steps, and still achieve the benefits and advantages of the present disclosure. Moreover, it should be apparent to one skilled in the art, that the disclosure may be practiced without some or all of the specific details and steps disclosed herein.

Aspects of the disclosed system may be implemented as a computer method or as an article of manufacture such as a memory device or non-transitory computer readable storage medium. The computer readable storage medium may be readable by a computer and may comprise instructions for causing a computer or other device to perform processes described in the present disclosure. The computer readable storage medium may be implemented by a volatile computer memory, non-volatile computer memory, hard drive, solid-state memory, flash drive, removable disk, and/or other media.

Embodiments of the present disclosure may be performed in different forms of software, firmware, and/or hardware. For example, an acoustic front end (AFE), may comprise, among other things, analog and/or digital filters (e.g., filters configured as firmware to a digital signal processor (DSP)). Further, the teachings of the disclosure may be performed by an application specific integrated circuit (ASIC), field programmable gate array (FPGA), or other component, for example.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements, and/or steps are in any way required for one or more embodiments or that one or more embodiments necessarily include logic for deciding, with or without other input or prompting, whether these features, elements, and/or steps are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Disjunctive language such as the phrase "at least one of X, Y, Z," unless specifically stated otherwise, is understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

As used in this disclosure, the term "a" or "one" may include one or more items unless specifically stated otherwise. Further, the phrase "based on" is intended to mean "based at least in part on" unless specifically stated otherwise.

What is claimed is:

1. A computer-implemented method, the method comprising:

generating, by a first device, first microphone audio data corresponding to a first microphone associated with the first device;

receiving, from a second device, second microphone audio data corresponding to a second microphone associated with the second device;

synchronizing the first microphone audio data and the second microphone audio data to generate first synchronized microphone audio data and second synchronized microphone audio data;

generating third microphone audio data by combining the first synchronized microphone audio data and the second synchronized microphone audio data; and sending the third microphone audio data to the second device, wherein the second device uses the third microphone audio data for further processing.

2. The computer-implemented method of claim 1, further comprising:

sending first output audio data to a loudspeaker associated with the first device; and generating first modified audio data by performing echo cancellation using the third microphone audio data and the first output audio data.

3. The computer-implemented method of claim 1, further comprising:

generating first modified audio data by performing first echo cancellation using the third microphone audio data;

receiving, from the second device, second modified audio data, wherein the second modified audio data was generated by the second device using second echo cancellation;

generating first output audio data by combining the first modified audio data and the second modified audio data; and sending the first output audio data to a loudspeaker associated with the first device.

4. The computer-implemented method of claim 3, further comprising:

determining a first delay value corresponding to a transit time between the second device and the first device;

generating second output audio data by delaying the first output audio data based on the first delay value; and generating, using the loudspeaker, output audio using the second output audio data.

5. The computer-implemented method of claim 1, further comprising:

generating first modified audio data by performing first echo cancellation using the third microphone audio data;

receiving, from the second device, second modified audio data, wherein the second modified audio data was generated by the second device using second echo cancellation;

generating first output audio data by combining the first modified audio data and the second modified audio data; and sending the first output audio data to the second device.

6. The computer-implemented method of claim 1, further comprising:

receiving first modified audio data originating from the second device, wherein the first modified audio data was generated by the second device using first echo cancellation;

receiving second modified audio data originating from a third device, wherein the second modified audio data was generated by the third device using second echo cancellation;

generating first output audio data by combining the first modified audio data and the second modified audio data; and sending the first output audio data to a loudspeaker associated with the first device.

7. The computer-implemented method of claim 6, further comprising:

generating third modified audio data by performing third echo cancellation using the third microphone audio data and the first output audio data;

generating second output audio data by combining the second modified audio data and the third modified audio data; and sending the second output audio data to the second device.

8. The computer-implemented method of claim 6, further comprising:

determining a first delay value corresponding to a transit time between the second device and the first device;

generating second output audio data by delaying the first output audio data based on the first delay value; and generating, using the loudspeaker, output audio using the second output audio data.

9. The computer-implemented method of claim 1, wherein generating the first microphone audio data further comprises:

determining a first delay value corresponding to a transit time between the second device and the first device;

receiving, from the first microphone, fourth microphone audio data; and generating the first microphone audio data by delaying the fourth microphone audio data based on the first delay value.

10. A system comprising:

at least one processor; and memory including instructions operable to be executed by the at least one processor to cause the system to:

generate, by a first device, first microphone audio data corresponding to a first microphone associated with the first device;

receive, from a second device, second microphone audio data corresponding to a second microphone associated with the second device;

synchronize the first microphone audio data and the second microphone audio data to generate first synchronized microphone audio data and second synchronized microphone audio data;

generate third microphone audio data by combining the first synchronized microphone audio data and the second synchronized microphone audio data; and send the third microphone audio data to the second device, wherein the second device uses the third microphone audio data for further processing.

11. The system of claim 10, wherein the memory further comprises instructions that, when executed by the at least one processor, further cause the system to:

send first output audio data to a loudspeaker associated with the first device; and generate first modified audio data by performing echo cancellation using the third microphone audio data and the first output audio data.

12. The system of claim 10, wherein the memory further comprises instructions that, when executed by the at least one processor, further cause the system to:

generate first modified audio data by performing first echo cancellation using the third microphone audio data;

receive, from the second device, second modified audio data, wherein the second modified audio data was generated by the second device using second echo cancellation;

generate first output audio data by combining the first modified audio data and the second modified audio data; and send the first output audio data to a loudspeaker associated with the first device.

13. The system of claim 12, wherein the memory further comprises instructions that, when executed by the at least one processor, further cause the system to:

determine a first delay value corresponding to a transit time between the second device and the first device;

generate second output audio data by delaying the first output audio data based on the first delay value; and generate, using the loudspeaker, output audio using the second output audio data.

14. The system of claim 10, wherein the memory further comprises instructions that, when executed by the at least one processor, further cause the system to:

generate first modified audio data by performing first echo cancellation using the third microphone audio data;

receive, from the second device, second modified audio data, wherein the second modified audio data was generated by the second device using second echo cancellation;

generate first output audio data by combining the first modified audio data and the second modified audio data; and send the first output audio data to the second device.

15. The system of claim 10, wherein the memory further comprises instructions that, when executed by the at least one processor, further cause the system to:

receive first modified audio data originating from the second device, wherein the first modified audio data was generated by the second device using first echo cancellation;

receive second modified audio data originating from a third device, wherein the second modified audio data was generated by the third device using second echo cancellation;

generate first output audio data by combining the first modified audio data and the second modified audio data; and send the first output audio data to a loudspeaker associated with the first device.

16. The system of claim 15, wherein the memory further comprises instructions that, when executed by the at least one processor, further cause the system to:

generate third modified audio data by performing third echo cancellation using the third microphone audio data and the first output audio data;

generate second output audio data by combining the second modified audio data and the third modified audio data; and send the second output audio data to the second device.

17. The system of claim 15, wherein the memory further comprises instructions that, when executed by the at least one processor, further cause the system to:

determine a first delay value corresponding to a transit time between the second device and the first device;

generate second output audio data by delaying the first output audio data based on the first delay value; and generate, using the loudspeaker, output audio using the second output audio data.

18. The system of claim 10, wherein the memory further comprises instructions that, when executed by the at least one processor, further cause the system to:

determine a first delay value corresponding to a transit time between the second device and the first device;

receive, from the first microphone, fourth microphone audio data; and generate the first microphone audio data by delaying the fourth microphone audio data based on the first delay value.

19. The computer-implemented method of claim 1, wherein the further processing comprises speech processing.

20. The system of claim 10, wherein the further processing comprises speech processing.

* * * * *